US011751646B2

(12) United States Patent
Cheng

(10) Patent No.: US 11,751,646 B2
(45) Date of Patent: Sep. 12, 2023

(54) GUN-SHAPED EAR PIERCER

(71) Applicant: Bo Cheng, Jiangxi (CN)

(72) Inventor: Bo Cheng, Jiangxi (CN)

(73) Assignee: Bo Cheng, NanChang (CN)

( * ) Notice: Subject to any disclaimer, the term of this patent is extended or adjusted under 35 U.S.C. 154(b) by 0 days.

(21) Appl. No.: 17/772,076

(22) PCT Filed: Apr. 10, 2020

(86) PCT No.: PCT/CN2020/084091

§ 371 (c)(1),
(2) Date: Apr. 26, 2022

(87) PCT Pub. No.: WO2021/184460

PCT Pub. Date: Sep. 23, 2021

(65) Prior Publication Data

US 2023/0000221 A1 Jan. 5, 2023

(30) Foreign Application Priority Data

Mar. 16, 2020 (CN) ..... 202010183292.2

(51) Int. Cl.
*A44C 7/00* (2006.01)

(52) U.S. Cl.
CPC ..... *A44C 7/001* (2013.01)

(58) Field of Classification Search
CPC ..... A44C 7/001
See application file for complete search history.

(56) References Cited

U.S. PATENT DOCUMENTS 4,068,668 A 1/1978 Moore et al.
5,263,960 A 11/1993 Mann
5,690,665 A * 11/1997 Mann ..... A44C 7/001 606/188
6,599,306 B1 7/2003 Reil

FOREIGN PATENT DOCUMENTS

CN 200994481 A 12/2007
CN 204671199 U 9/2015
CN 110691534 A 1/2020
DE 69211871 T2 11/1996
(Continued)

OTHER PUBLICATIONS

International Search Report of PCT/CN2020/084091.
Written Opinion of PCT/CN2020/084091.

*Primary Examiner* — Todd J Scherbel

(57) ABSTRACT

A gun-shaped ear piercer, comprising a front portion (1) and a rear portion (2) which are sleeved and can move relatively. A track (7), having a front slot (7*a*) for mounting a stud base mounting portion (9) disposed on one end thereof away from the rear portion (2), as well as a fixed portion (11) for mounting a stud mounting portion (10) disposed thereon in a sliding manner, is disposed on the front portion (1). A firing device corresponding to the fixed portion (11) is disposed on the rear portion (2). The front portion (1) comprises a grip having an unlocking trigger (6) disposed on a front side thereof, an elastic reset device as well as an aiming stroke restrainer are disposed between the front portion (1) and the rear portion (2), the aiming stroke restrainer is used to restrain the firing device from moving to an aimed position.

14 Claims, 20 Drawing Sheets

(56) References Cited

FOREIGN PATENT DOCUMENTS

| | | | |
|---|---|---|---|
| EP | 0293553 | A1 | 12/1988 |
| EP | 0500082 | A1 | 8/1992 |
| FR | 2322562 | A1 | 4/1977 |
| GB | 2187960 | A | 9/1987 |
| GB | 2270026 | A | 3/1994 |
| JP | 2652608 | B2 | 9/1997 |
| JP | H1023909 | A | 1/1998 |
| JP | H11164713 | A | 6/1999 |
| KR | 20170065270 | A | 6/2017 |

* cited by examiner

GUN-SHAPED EAR PIERCER

CROSS-REFERENCE TO RELATED APPLICATIONS

This Application is a national stage application of PCT/CN2020/084091. The present application claims priorities from PCT Application No. PCT/CN2020/084091, filed Apr. 10, 2020, and from the Chinese Patent Application No. 202010183292.2, filed to the CNIPA on Mar. 16, 2020, titled "Gun-Shaped Ear Piercer", which are incorporated herein by reference in its entirety.

TECHNICAL FIELD

The present application relates to the technical field of auxiliary ornament mounting devices, in particular to a gun-shaped ear piercer.

BACKGROUND OF THE PRESENT INVENTION

Spring-driven gun-shaped ear piercers, with similar components such as a piercer body, a stud mounting portion and a stud base mounting portion, have been around for a long time. In a process of ear piercing, the stud mounting portion and the stud base mounting portion are firstly brought closer to the earlobe, and then a trigger releases a pre-compressed spring, so that the spring drives the stud mounting portion to move forward, and a tip of a stud is pierced into a stud base after piercing through the earlobe. Then the stud mounting portion and the stud base mounting portion are separated from each other and detached from the body of the gun-shaped ear piercer at the same time, leaving the stud and the stud base on the earlobe. In this way, the entire ear piercing process is completed.

At present, in the process of ear piercing, in order to avoid the pain caused by piercing the ears twice respectively, two piercers generally needs to aim at the earlobes on both sides for positioning, and then triggers are pulled to release firing springs at the same time, so that the ear piercing operation on both sides can be carried out at the same time, ensuring that customers will get pain only once, reducing customer's discomfort and improving customer experience.

In existing gun-shaped ear piercers, the stud base mounting portion is driven to get close to the stud mounting portion by pulling the trigger (the stud mounting portion keeps still while the stud base mounting portion moves closer), and the firing spring is released by triggering when the stud base mounting portion further moves to a certain position. Such structure is not conducive to keeping the first gun-shaped ear piercer still after this piercer aims at the earlobe, and false triggering occurs easily.

In order to solve this problem, in the prior art, the stud base mounting portion is driven to get close to the stud mounting portion by pulling the trigger (the stud mounting portion keeps still while the stud base mounting portion moves closer), and then the firing spring is unlocked by the thumb. With this design, the requirement of keeping the first gun-shaped ear piercer still after this piercer aims at the earlobe can be met to avoid false triggering. However, triggering by the thumb will cause a large hand motion, which easily makes the position of the first gun-shaped ear piercer held by hand deviate from a piercing position, and thus results in an offset piercing position on the ear.

SUMMARY OF THE PRESENT INVENTION

Therefore, the technical problem to be solved in the present application is to provide a gun-shaped ear piercer, which can reduce the finger motion amplitude of operators in the process of ear piercing and improve the accuracy and efficiency of ear piercing.

In order to solve the above problems, a gun-shaped ear piercer is provided according to the present application, comprising a front portion and a rear portion, which are sleeved together and can move relatively; a track, having a front slot for mounting a stud base mounting portion disposed on one end thereof away from the rear portion, as well as a fixed portion for mounting a stud mounting portion disposed thereon in a sliding manner, is disposed on the front portion; a firing device corresponding to the fixed portion is disposed on the rear portion; and the front portion comprises a grip having an unlocking trigger disposed on a front side thereof, an elastic reset device as well as an aiming stroke restrainer are disposed between the front portion and the rear portion, the aiming stroke restrainer is configured to restrain the firing device from moving to an aimed position when firing device is in an aiming stroke, and the unlocking trigger is configured to trigger the firing device to enter an piercing stroke for piercing the earlobe.

Optionally, a spring locking piece, which is disposed on a firing path of the firing device for locking the firing device, is disposed in the rear portion, and the unlocking trigger is in drive connection with spring locking piece to drive the spring locking piece to unlock the firing device.

Optionally, the spring locking piece is disposed on the rear portion, a torsion spring for returning the spring locking piece is disposed between the spring locking piece and the rear portion, and the spring locking piece comprises a locking end configured to lock the firing device and a triggering end configured to unlock together with the unlocking trigger.

Optionally, a hollow tube is disposed on the top of the rear portion, the firing device comprises a firing pin and a firing spring, which are mounted in the hollow tube, and both ends of the firing spring are elastically propped against the firing pin and the firing spring respectively; and a strip-shaped notch is disposed below the hollow tube, and the locking end of the spring locking piece extends into the notch to lock the firing device together with the firing pin.

Optionally, a ring groove is disposed on the firing pin, and the locking end of the spring locking piece is snapped into the ring groove when the spring locking piece is locked, and is detached from the ring groove when the spring locking piece is unlocked.

Optionally, the firing pin comprises a major-diameter section disposed at a front end thereof, as well as a minor-diameter section disposed at a rear end thereof and coming out from the hollow tube, the ring groove is disposed at the major-diameter section, one end of the firing spring is propped against one end of the major-diameter section connected to the minor-diameter section, while the other end thereof is propped against an end wall of the hollow tube.

Optionally, a mounting groove, having the unlocking trigger disposed therein, is disposed on a front side of the grip of the front portion, a first end of the unlocking trigger is hinged to the front portion and connected to the front portion through a torsion spring, while a second end thereof is blocked on an inner wall of the front portion; a trigger boss is disposed on the top of the unlocking trigger, and a side catch is disposed on at least one side of the unlocking trigger; and a straight slot is disposed on a lower side of the rear portion, the trigger boss is at least partially disposed in the straight slot, and the side catch is blocked outside the straight slot.

Optionally, a blocking piece protruding towards the unlocking trigger is further disposed on the lower side of the rear portion, the spring locking piece is disposed at a rear side of the blocking piece; before the front portion and the rear portion are completely closed, the trigger boss of the unlocking trigger is located at the blocking piece, and the unlocking trigger is pressed against the inner wall of the front portion by the blocking piece; after the front portion and the rear portion are completely closed, the trigger boss of the unlocking trigger is staggered from the blocking piece and is fitted to the triggering end of the spring locking piece; the unlocking trigger can be pulled, and the trigger boss of the unlocking trigger can drive the triggering end of the spring locking piece to move, so that the locking end of the spring locking piece is dislocated from a locked position to unlock the firing device.

Optionally, the rear portion is sleeved in the front portion, and the aiming stroke restrainer comprises stop pins disposed on the front portion, and stop grooves disposed on the rear portion; the stop pins are disposed on an upper portion and a lower portion of a fitting portion of the front portion and the rear portion respectively, and the stop grooves are disposed at corresponding positions of the rear portion, and the stroke of the stop pin in the stop groove is the aiming stroke.

Optionally, the fixed portion and the rear portion are disposed separately, the stop pin is disposed on the front portion, the stop groove in which the stop pin can slide is disposed on the rear portion, and a fixed portion return spring, with one end hooked to the stop pin and the other end connected to the fixed portion, is connected between the fixed portion and the front portion.

Optionally, the front portion is further provided with a stopper which is stopped between the fixed portion and an end of the hollow tube, so that a clearance is formed between the fixed portion and the hollow tube while the fixed portion return spring generates a pretensioning force before the front portion and the rear portion are closed.

Optionally, the gun-shaped ear piercer further comprises the stud mounting portion having an elastic track, a stud holder and a stud, the elastic track is tubular and comprises a radial slit extending in the movement direction of the stud.

Optionally, the fixed portion is disposed at the end of the hollow tube and forms an integrated structure with the hollow tube.

Optionally, the gun-shaped ear piercer further comprises the stud mounting portion having two elastic tracks, a stud which can slide in the elastic track is disposed in each track, and the stud mounting portion is of a centrosymmetric structure.

Optionally, the elastic track is of a tubular structure having a cylindrical inner cavity as well as at least two straight slots axially extending, and at least one straight slot runs through a tube wall of the tubular structure.

Optionally, the two straight slots of the tubular structure are located at both ends of the same diameter of the tubular structure respectively, and run through tube wall of the tubular structure.

Optionally, the two straight slots of the tubular structure are located at both ends of the same diameter of the tubular structure respectively, where one straight slot runs through the tube wall of the tubular structure, and the other straight slot, having a slot depth less than a wall thickness of the tubular structure, is located on an outer wall or an inner wall of the tubular structure.

The gun-shaped ear piercer provided according to the present application comprises a front portion and a rear portion, which are sleeved together and can move relatively; a track, having a front slot for mounting a stud base mounting portion disposed on one end thereof away from the rear portion, as well as a fixed portion for mounting a stud mounting portion disposed thereon in a sliding manner, is disposed on the front portion; a firing device corresponding to the fixed portion is disposed on the rear portion; and the front portion comprises a grip having an unlocking trigger disposed on a front side thereof, an elastic reset device as well as an aiming stroke restrainer are disposed between the front portion and the rear portion, the aiming stroke restrainer is configured to restrain the firing device from moving to an aimed position when firing device is in an aiming stroke, and the unlocking trigger is configured to trigger the firing device to enter an piercing stroke for piercing the earlobe. The front portion and the rear portion of the gun-shaped ear piercer are reset by the elastic reset device, and the aiming stroke is confined by the aiming stroke restrainer, so that the gun-shaped ear piercer can stably be stopped at the aimed position after entering the aiming stroke to meet the requirement of keeping a first ear piercer that aims at the earlobe still, and the firing device is triggered by the separate unlocking trigger to enter the piercing stroke to make a stud pierce through the earlobe. Since the unlocking trigger is located at a front side of the grip of the front portion, the unlocking trigger when pulled may be held and triggered by fingers except the thumb. Slight hand motion may effectively avoid the problem that the first ear piercer deviates from a piercing position in the process of triggering with the thumb, and ensure that two gun-shaped ear piercers operate at the same time to make the piercing positions more accurate and hardly deviate from the piercing position, thus improving the convenience and accuracy of ear piercing operations.

in which:

1: Front portion; 1*a*: Front piece; 1*b*: Back piece; 1*c*: Stop pin; 1*d*: Stop pin; 1*e*: Stop pin; 1*f*: Stopper; 2: Rear portion; 2*a*: Hollow tube; 2*b*: Notch; 2*c*: Stop groove; 2*d*: Stop groove; 2*e*: Stop groove; 2*f*: Blocking piece; 2*g*: End face of hollow tube; 2*h*: Straight slot; 3: Firing pin; 3*a*: Tail hook; 3*b*: Ring groove; 4: Firing spring; 5: Spring locking piece; 5*a*: Torsion spring; 5*b*: Triggering end; 5*c*: Locking end; 6: Unlocking trigger; 6*a*: Torsion spring; 6*b*: Side baffle; 6*c*: Trigger boss; 7: Track; 7*a*: Front slot; 8: Handle return spring; 9: Stud base mounting portion; 9*a*: Stud base; 10: Stud mounting portion; 10*a*: Stud; 10*b*: Stud holder; 10*b*1: Clamping piece; 10*b*2: Clamping piece; 10*c*: Stud tip; 10*d*: elastic track; 10*e*: Insert; 10*f*: Slit; 10*g*: Stud head; 10*h*: Flute; 11: Fixed portion; 11*a*: Fixed portion slot; 11*b*: Fixing portion return spring; 12: Clearance; and 13: Blister box.

DETAILED DESCRIPTION OF THE PRESENT INVENTION

Figure 1:
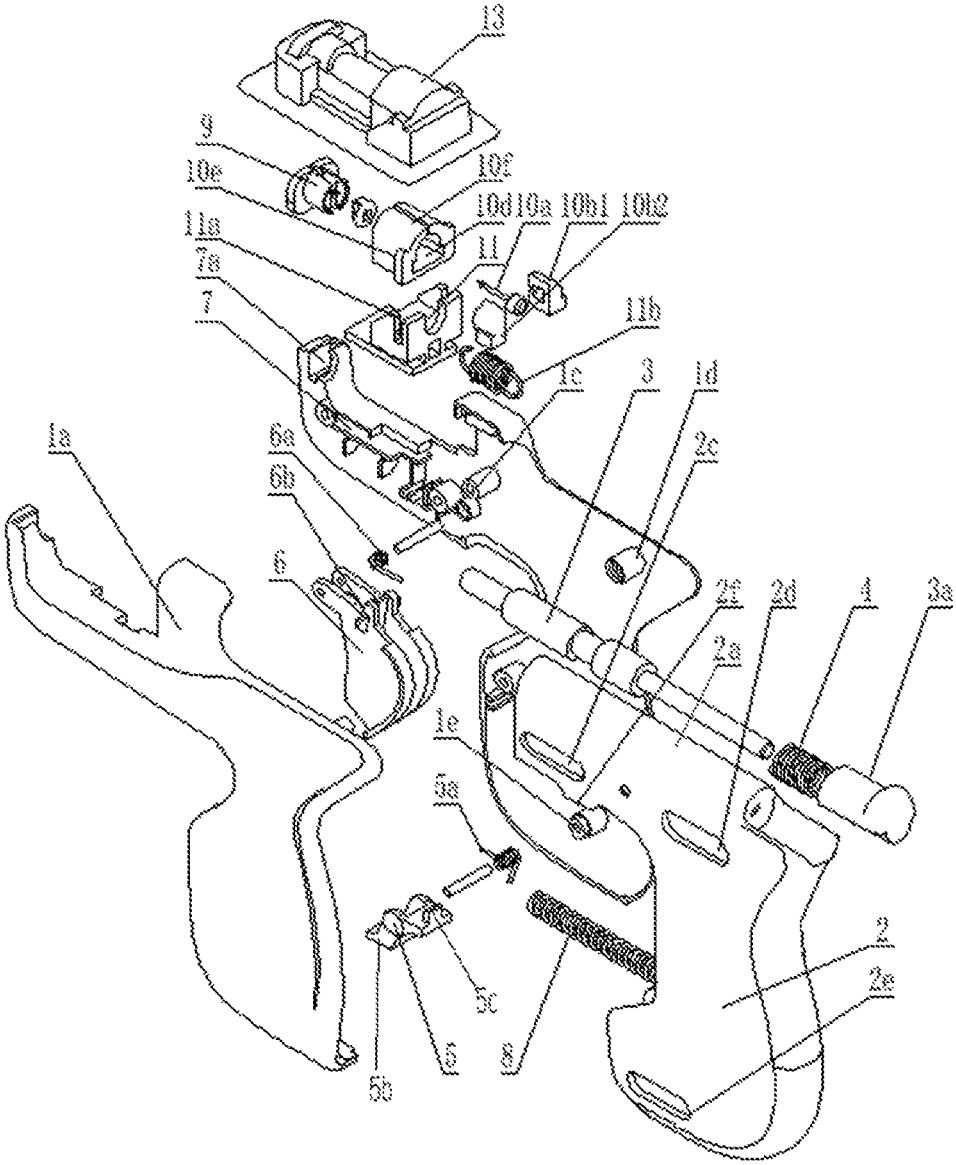
FIG. 1 is an exploded structural view of a gun-shaped ear piercer according to a first embodiment of the present application.
Figure 2:
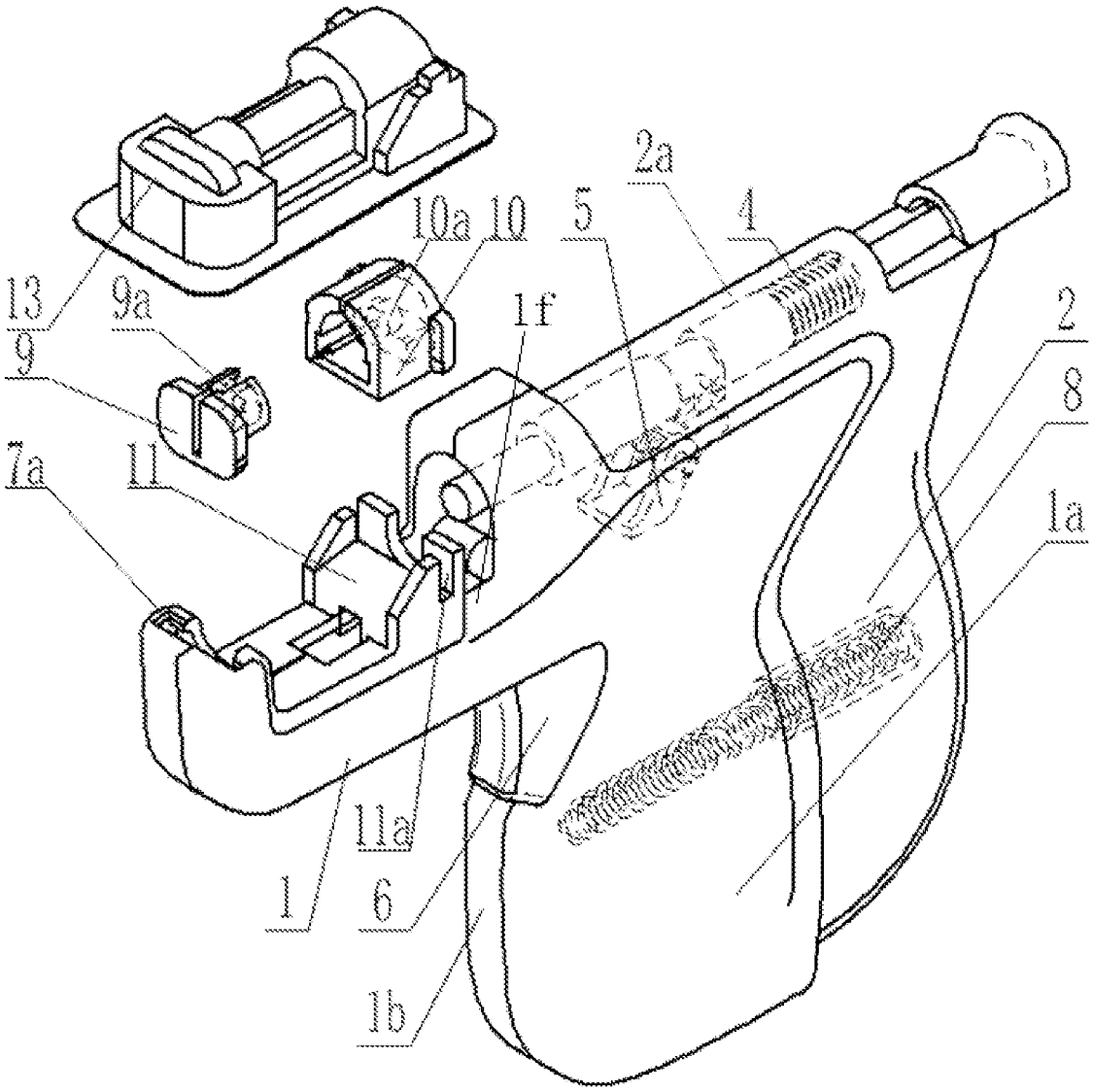
FIG. 2 is a perspective structural view of the gun-shaped ear piercer according to the first embodiment of the present application.
Figure 3:
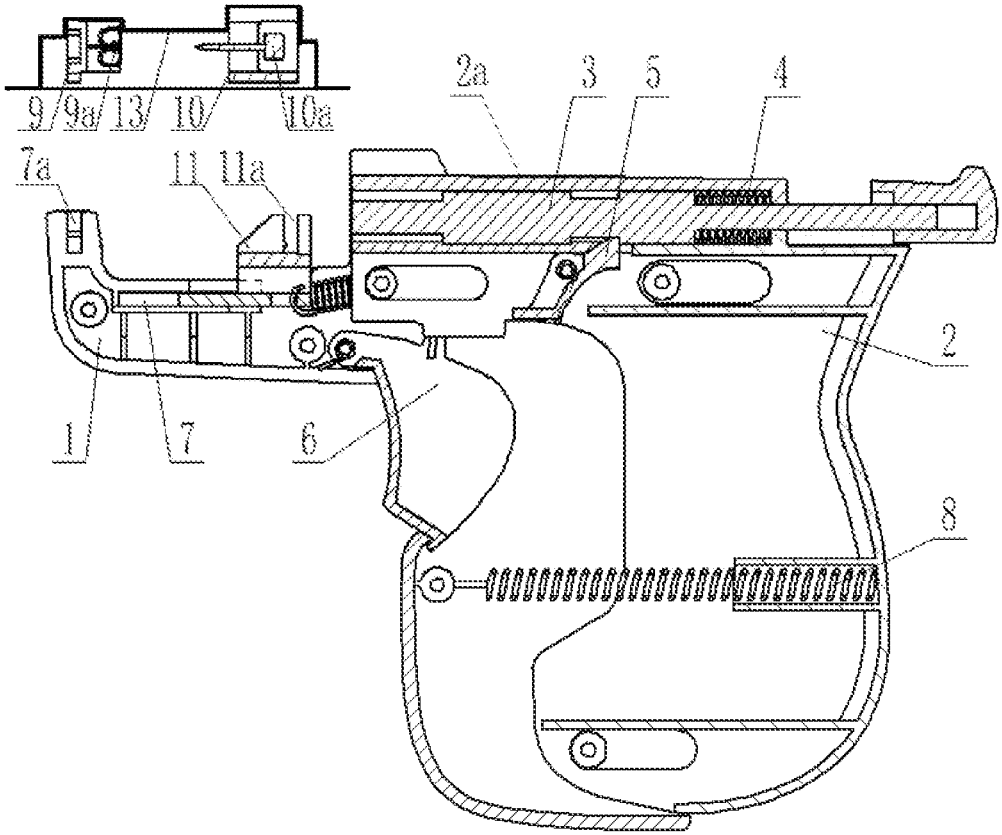
FIG. 3 is a sectional structural view of the gun-shaped ear piercer according to the first embodiment of the present application.
Figure 4:
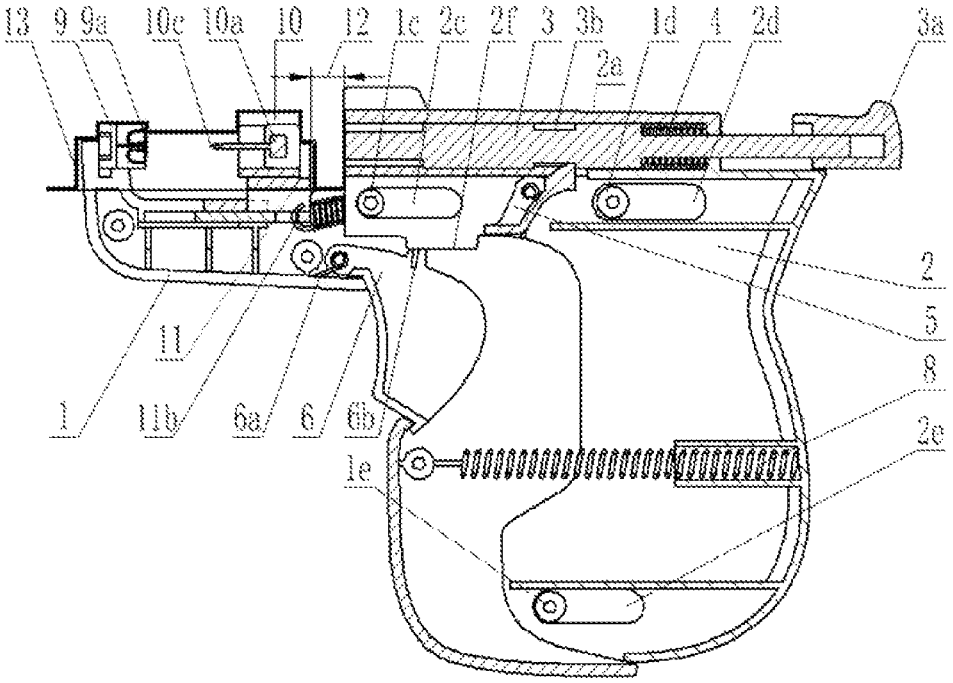
FIG. 4 is a state diagram in which studs and stud bases of the gun-shaped ear piercer are mounted according to the first embodiment of the present application.
Figure 5:
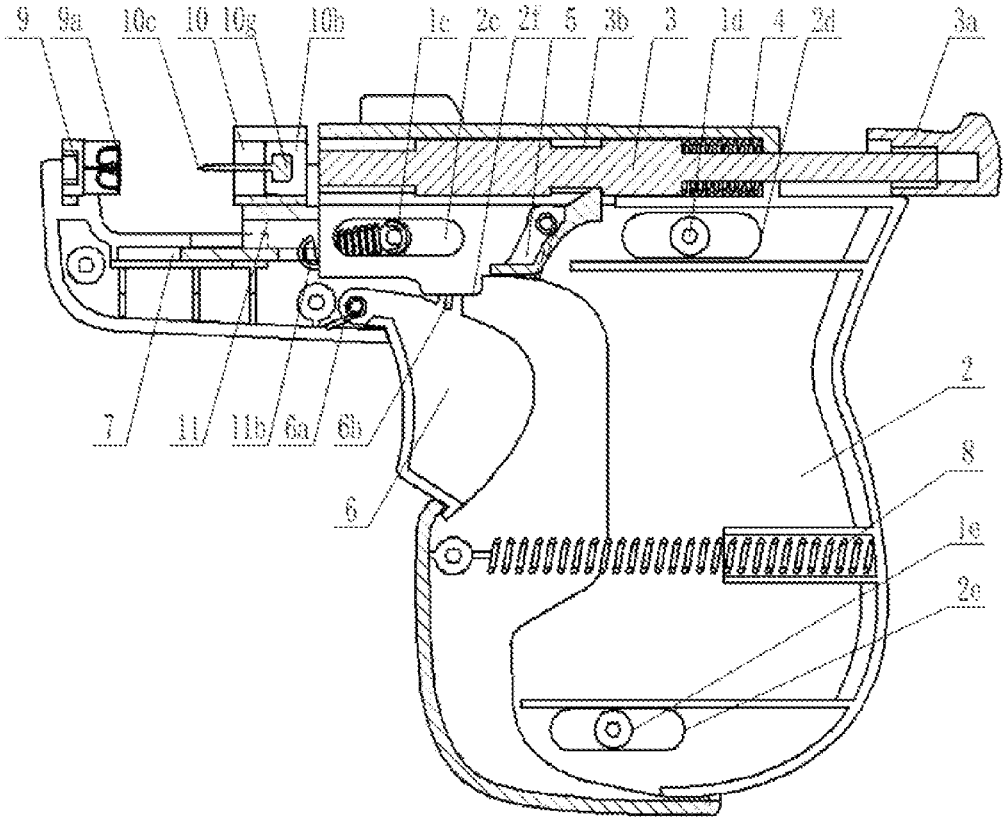
FIG. 5 is a state diagram of the gun-shaped ear piercer after finishing an idle stroke according to the first embodiment of the present application.
Figure 6:
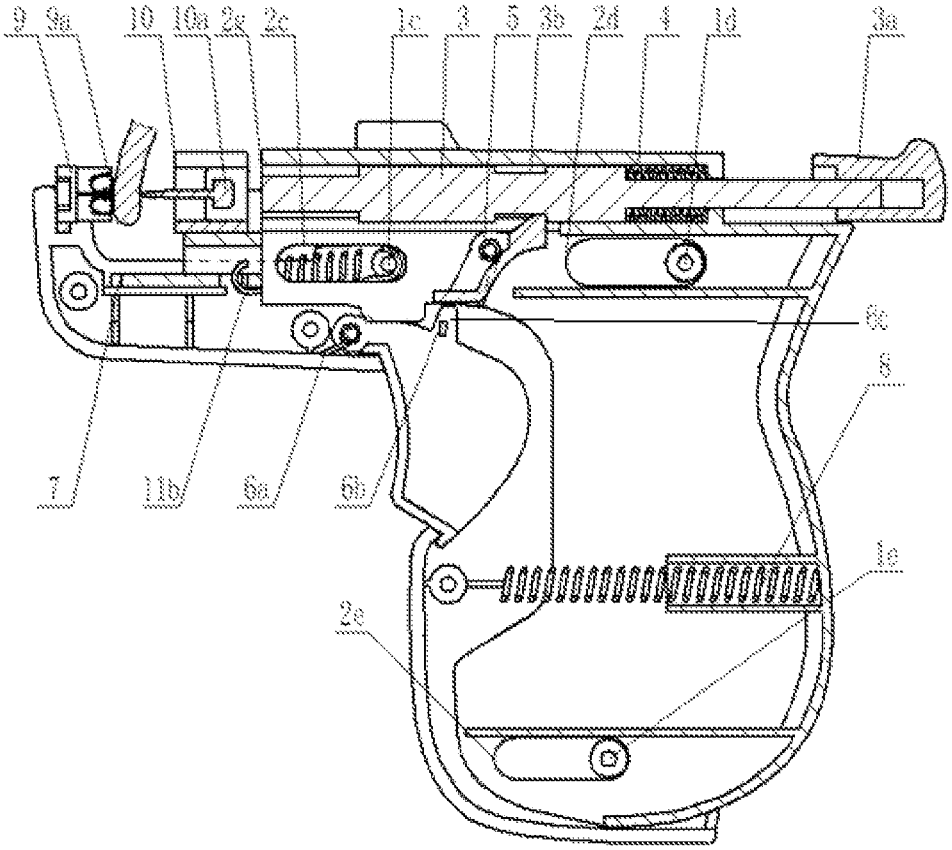
FIG. 6 is a state diagram of the gun-shaped ear piercer after finishing an aiming stroke according to the first embodiment of the present application.
Figure 7:
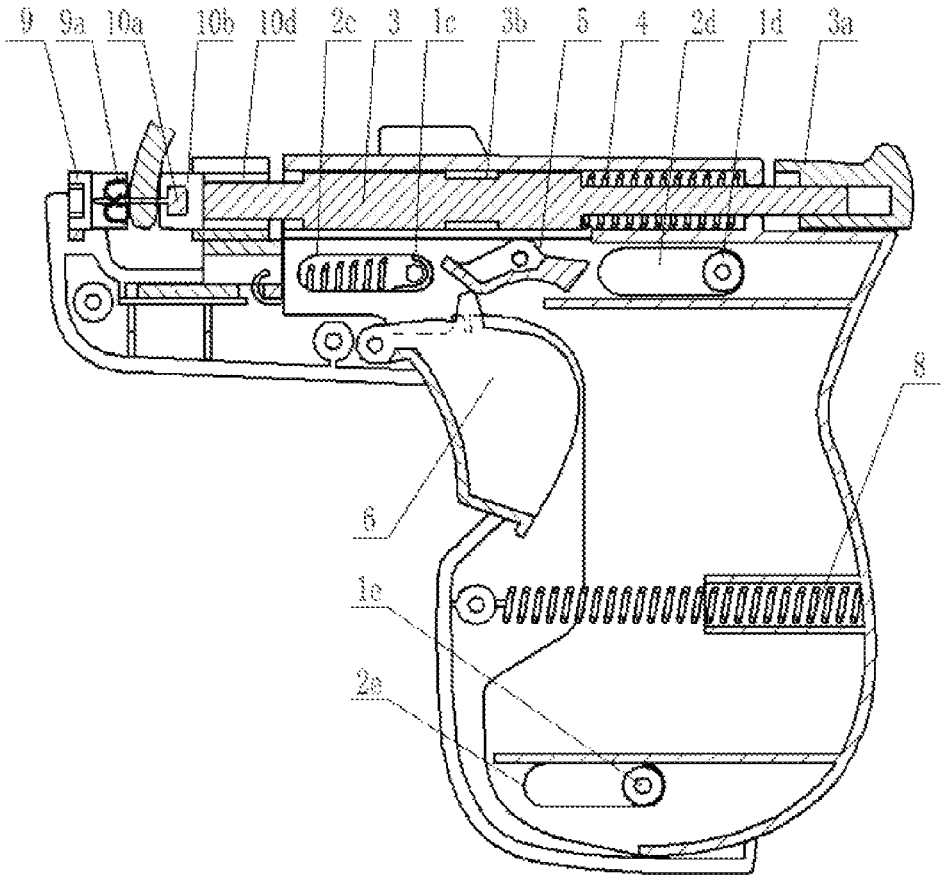
FIG. 7 is a state diagram of the gun-shaped ear piercer after finishing a piercing stroke according to the first embodiment of the present application.
Figure 8:
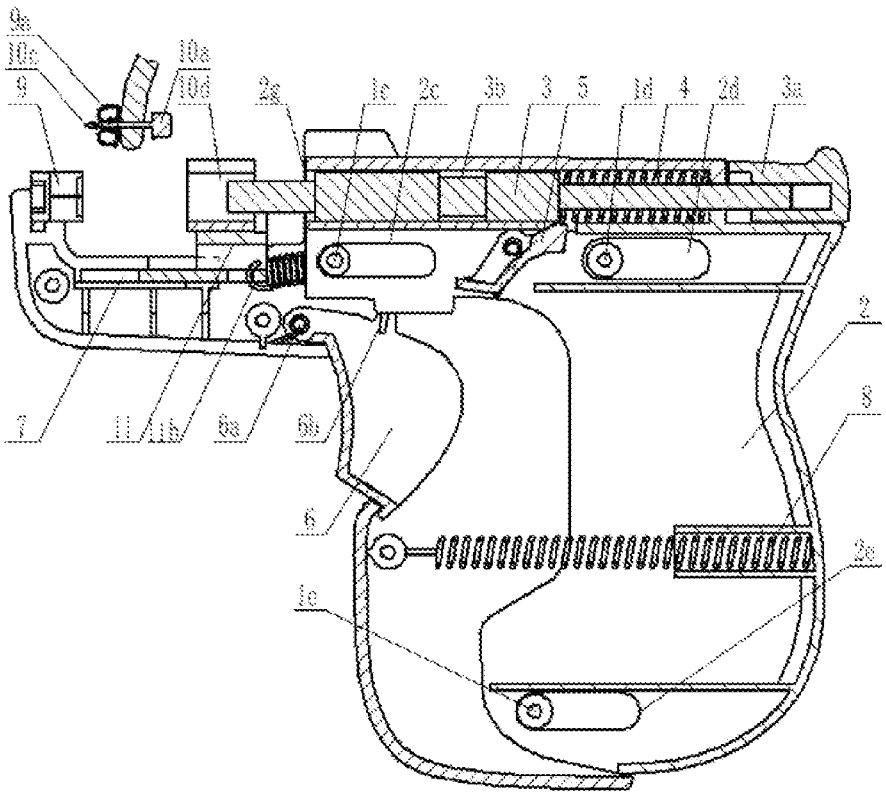
FIG. 8 is a schematic diagram of a reset state of the gun-shaped ear piercer according to the first embodiment of the present application.
Figure 9:
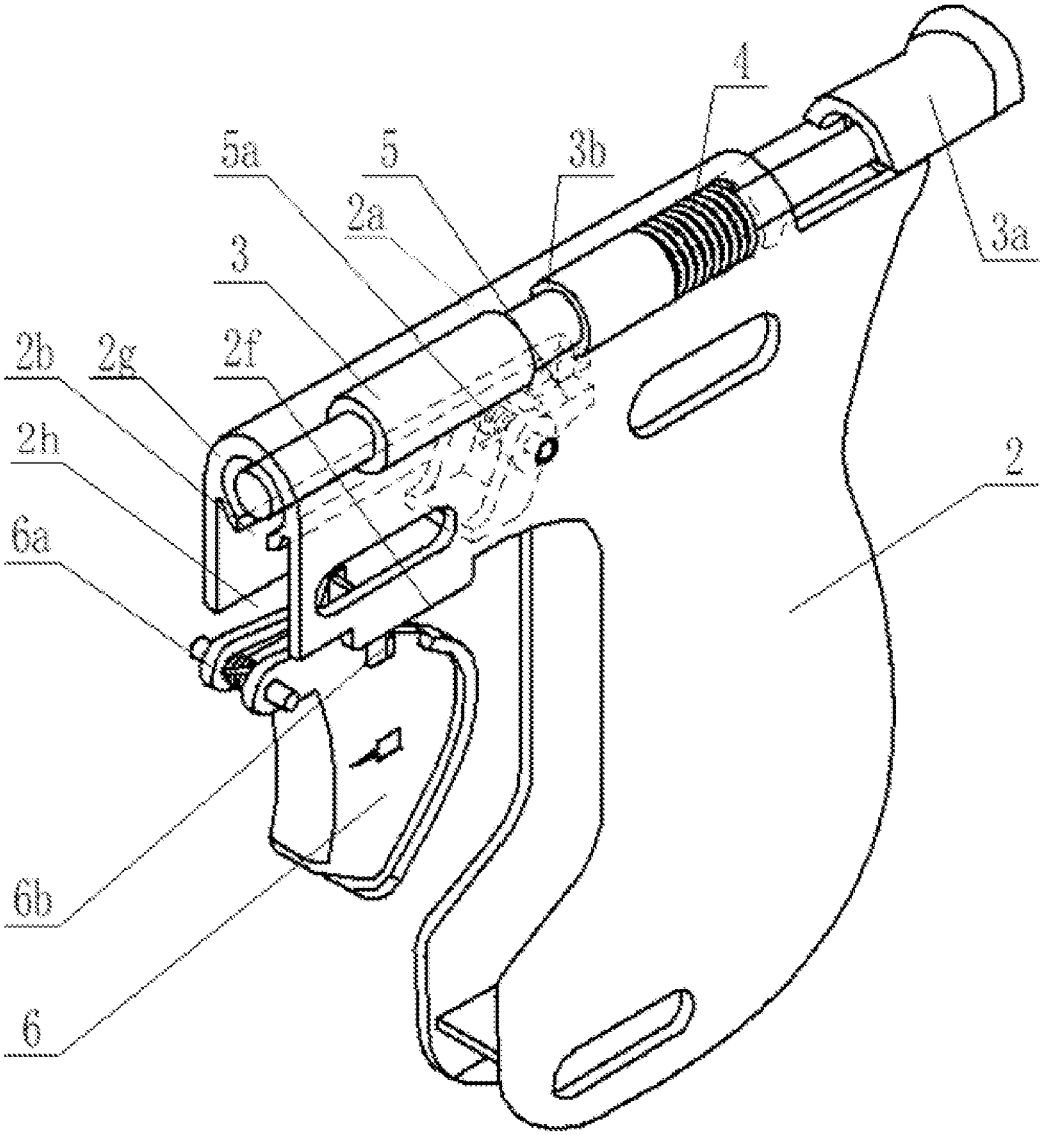
FIG. 9 is a schematic diagram of a spring locking piece and an unlocking trigger of the gun-shaped ear piercer according to the first embodiment of the present application.
Figure 10:
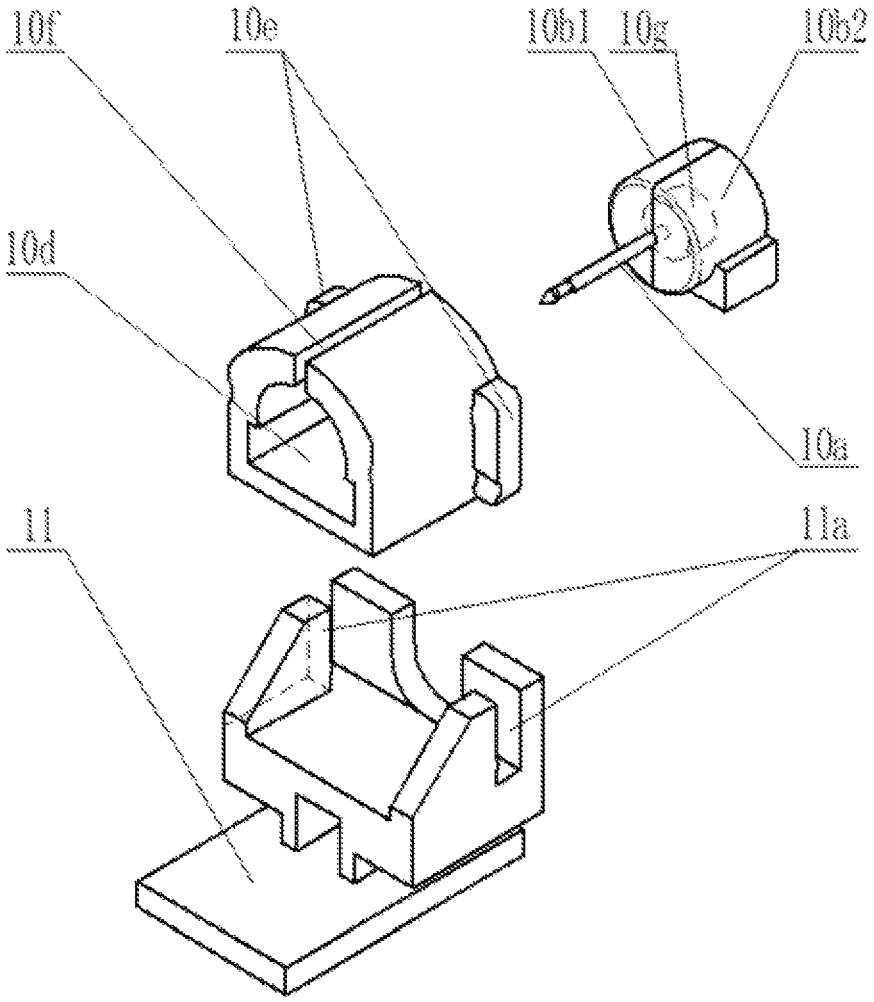
FIG. 10 is an exploded structural view of a stud mounting portion of the gun-shaped ear piercer according to the first embodiment of the present application.
Figure 11:
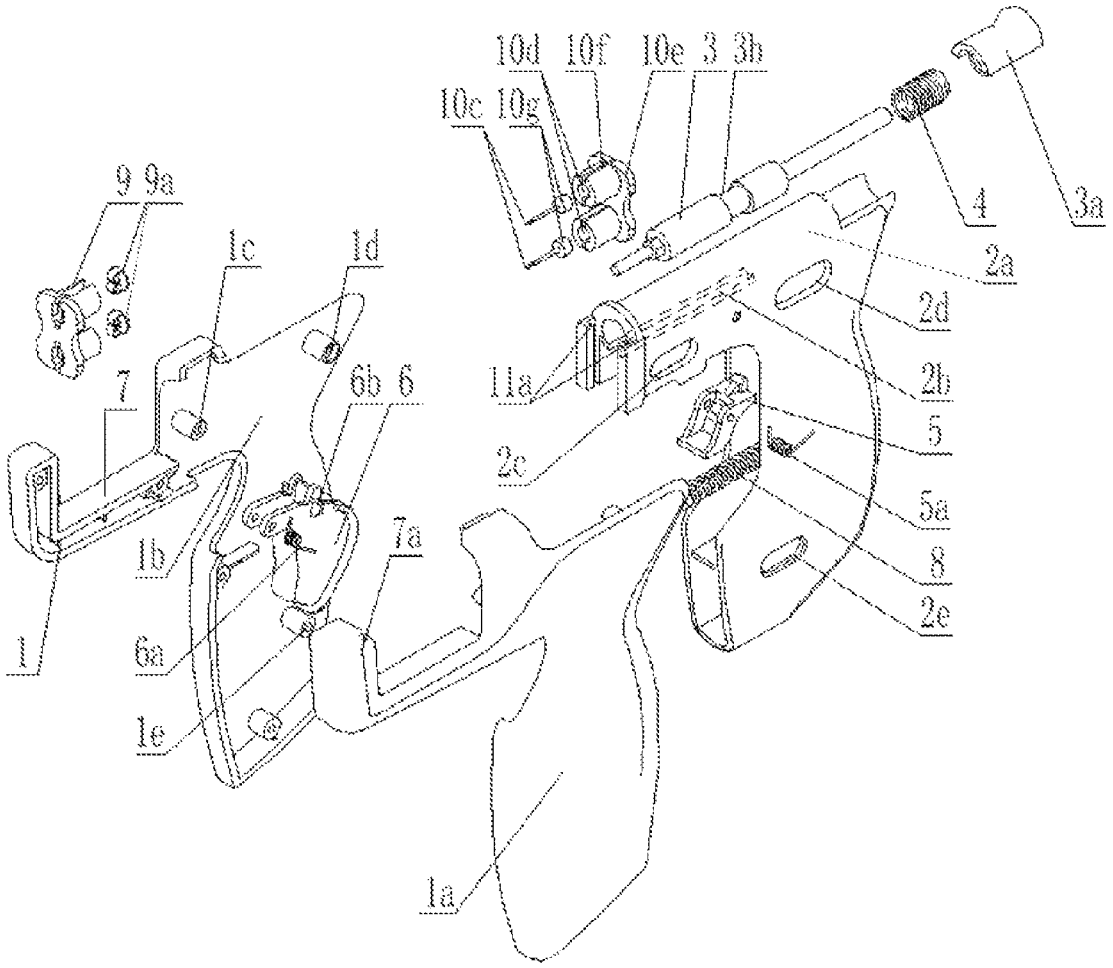
FIG. 11 is an exploded structural view of a gun-shaped ear piercer according to a second embodiment of the present application.
Figure 12:
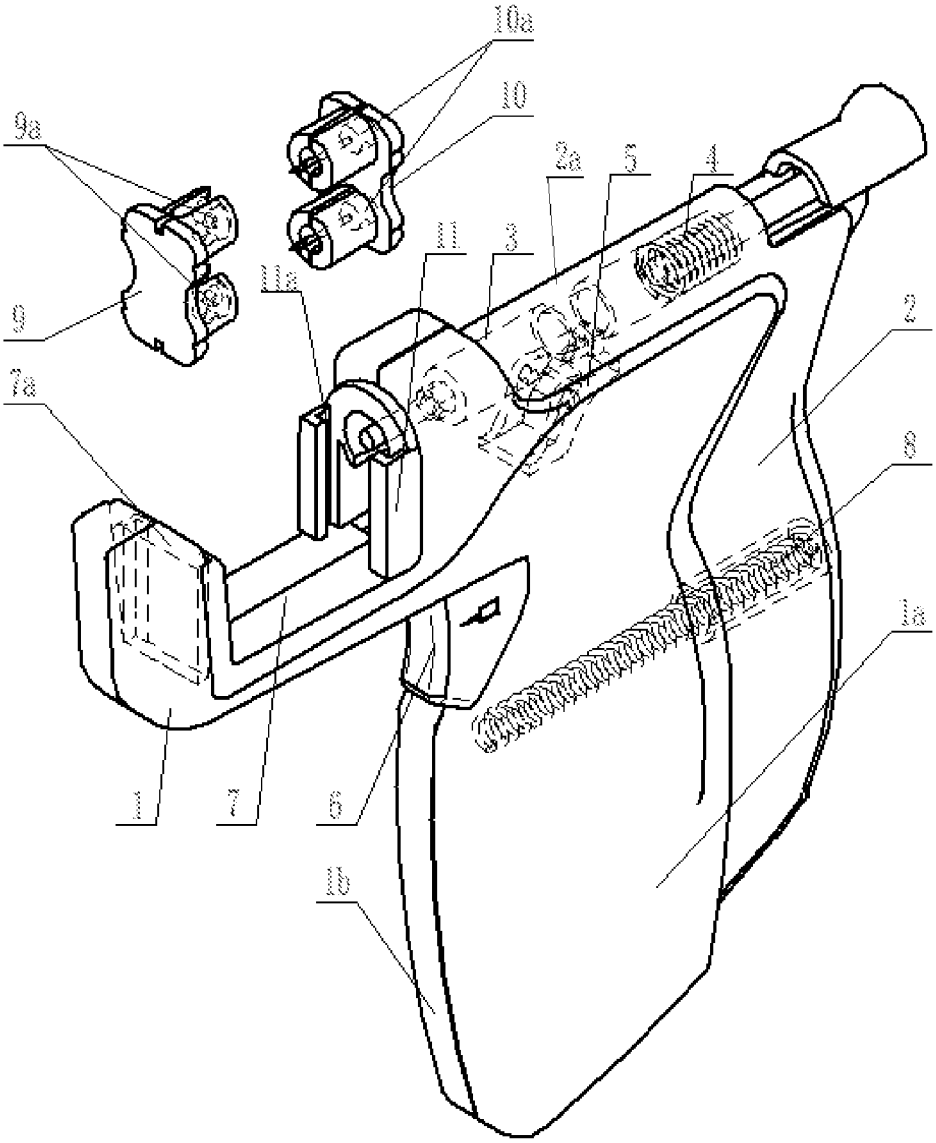
FIG. 12 is a perspective structural view of the gun-shaped ear piercer according to the second embodiment of the present application.
Figure 13:
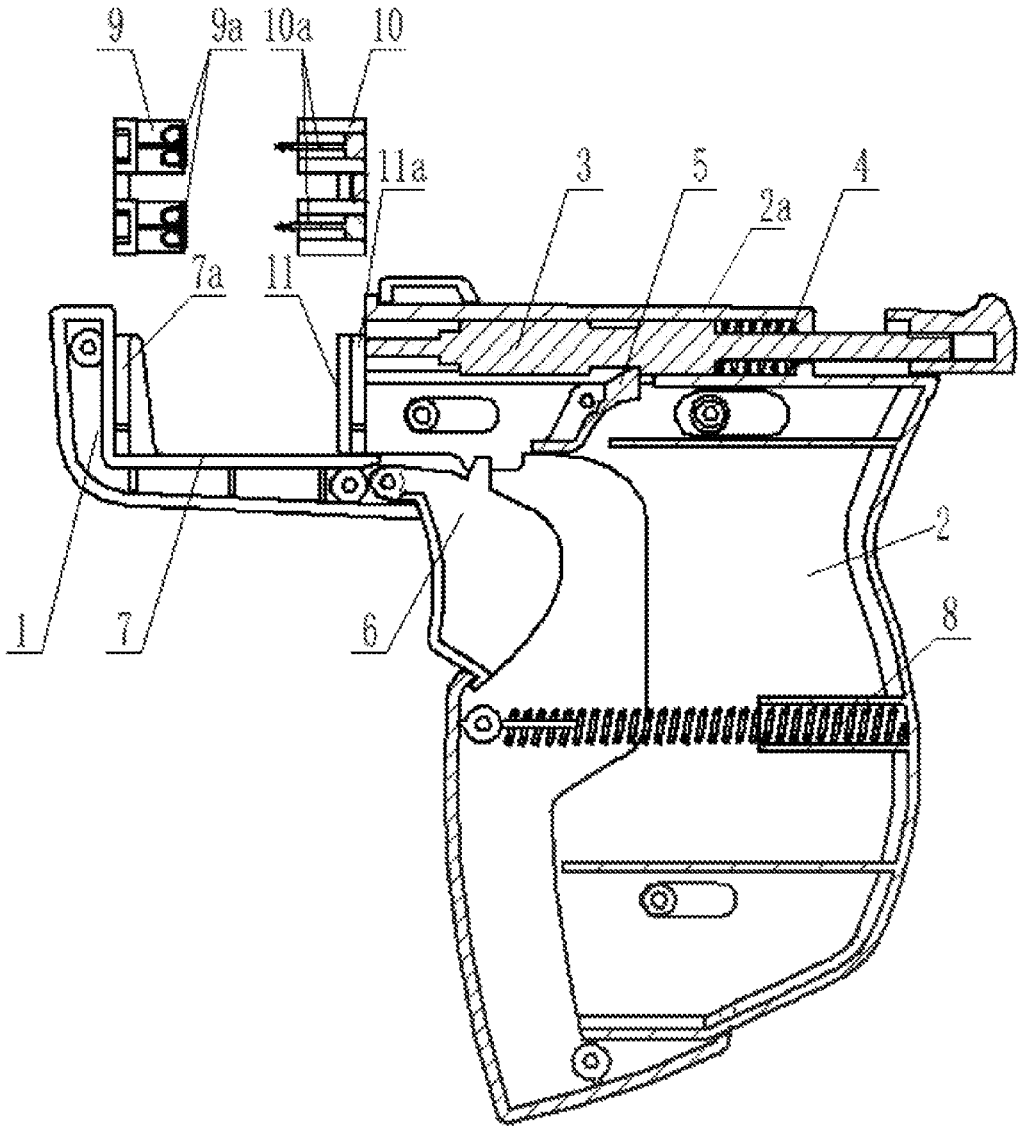
FIG. 13 is a sectional structural view of the gun-shaped ear piercer according to the second embodiment of the present application.
Figure 14:
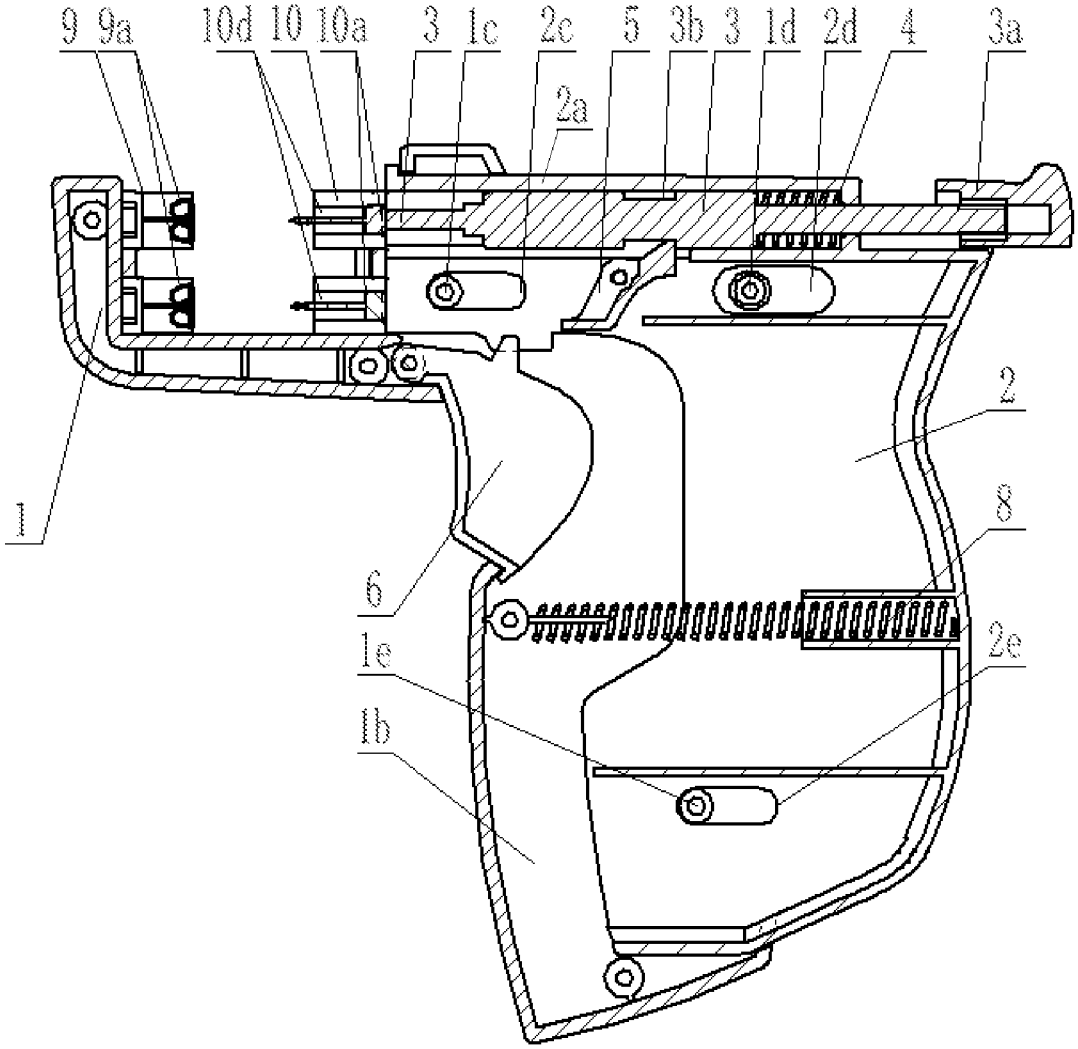
FIG. 14 is a state diagram in which a stud and a stud base of the gun-shaped ear piercer are mounted according to the second embodiment of the present application.
Figure 15:
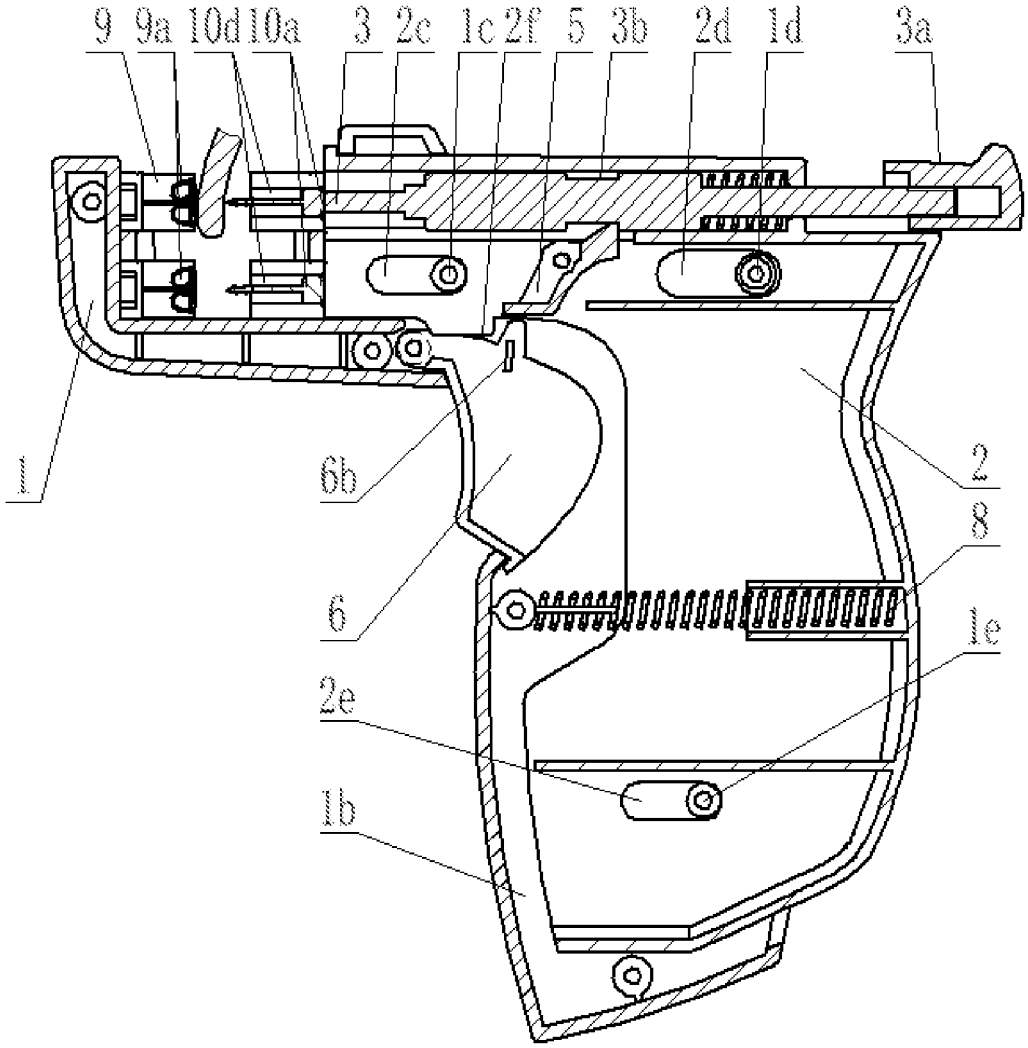
FIG. 15 is a state diagram of the gun-shaped ear piercer after finishing an aiming stroke according to the second embodiment of the present application.
Figure 16:
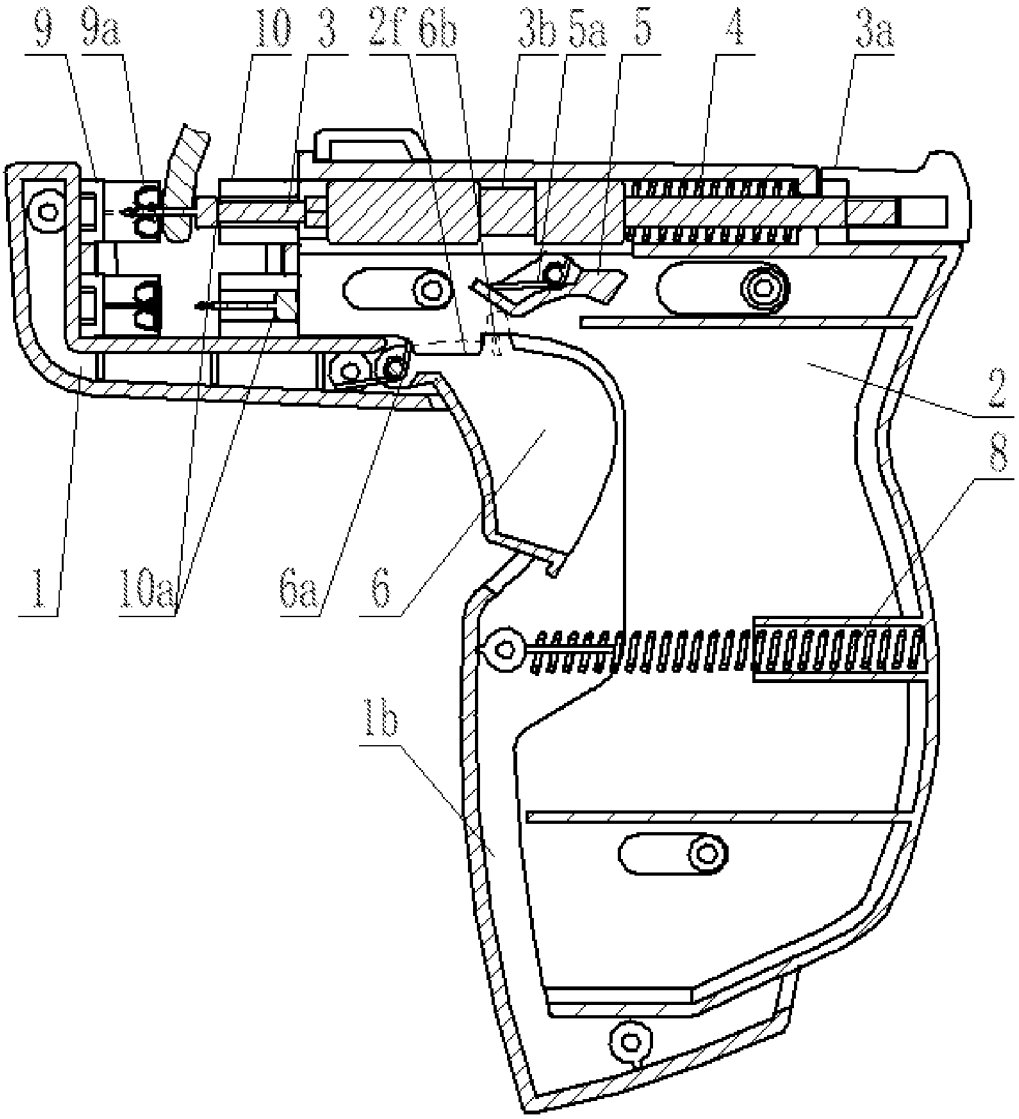
FIG. 16 is a state diagram of the gun-shaped ear piercer after finishing a piercing stroke according to the second embodiment of the present application.
Figure 17:
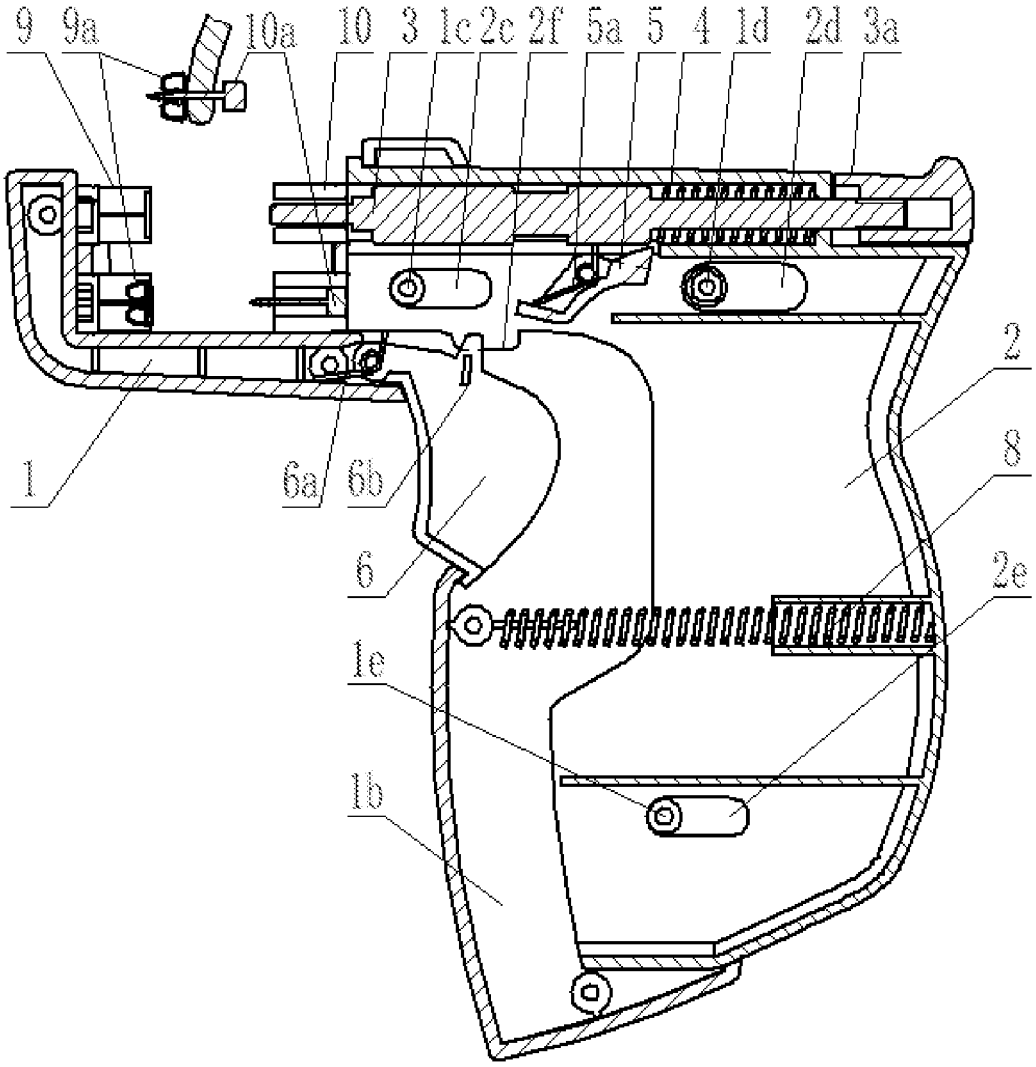
FIG. 17 is a schematic diagram of a reset state of the gun-shaped ear piercer according to the second embodiment of the present application.
Figure 18:
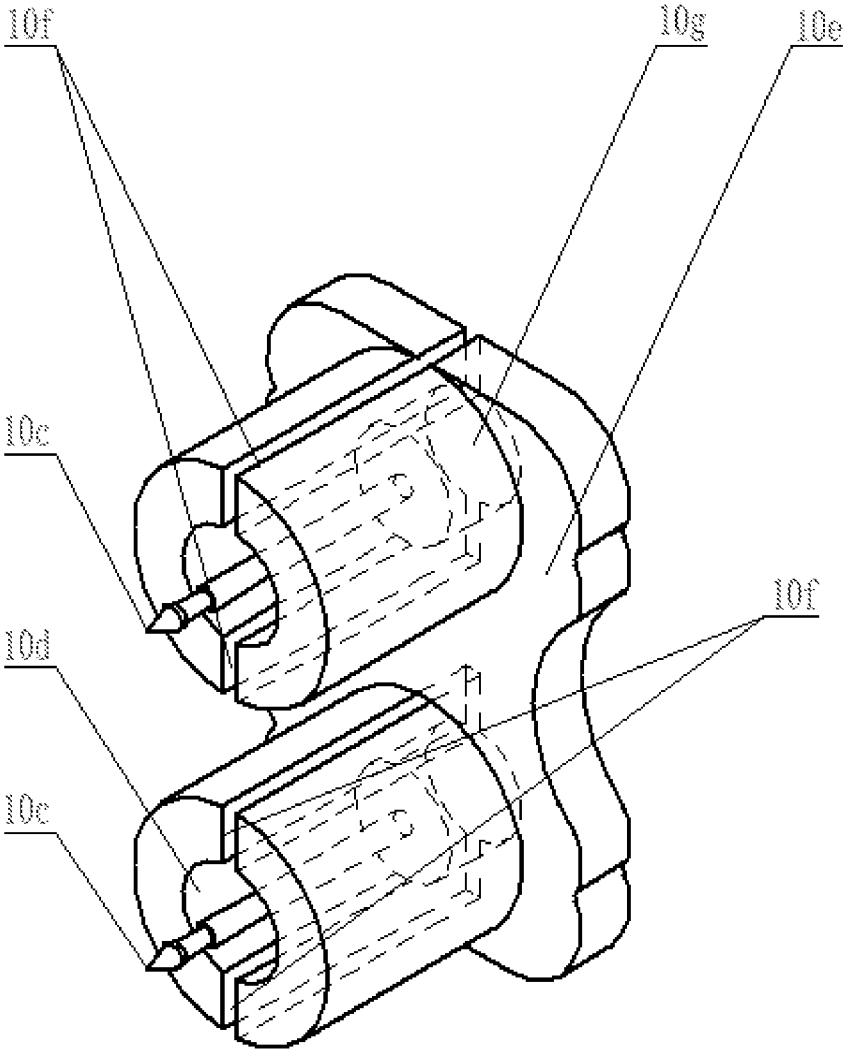
FIG. 18 is a structural diagram of a first type of stud mounting portion of the gun-shaped ear piercer according to the second embodiment of the present application.
Figure 19:
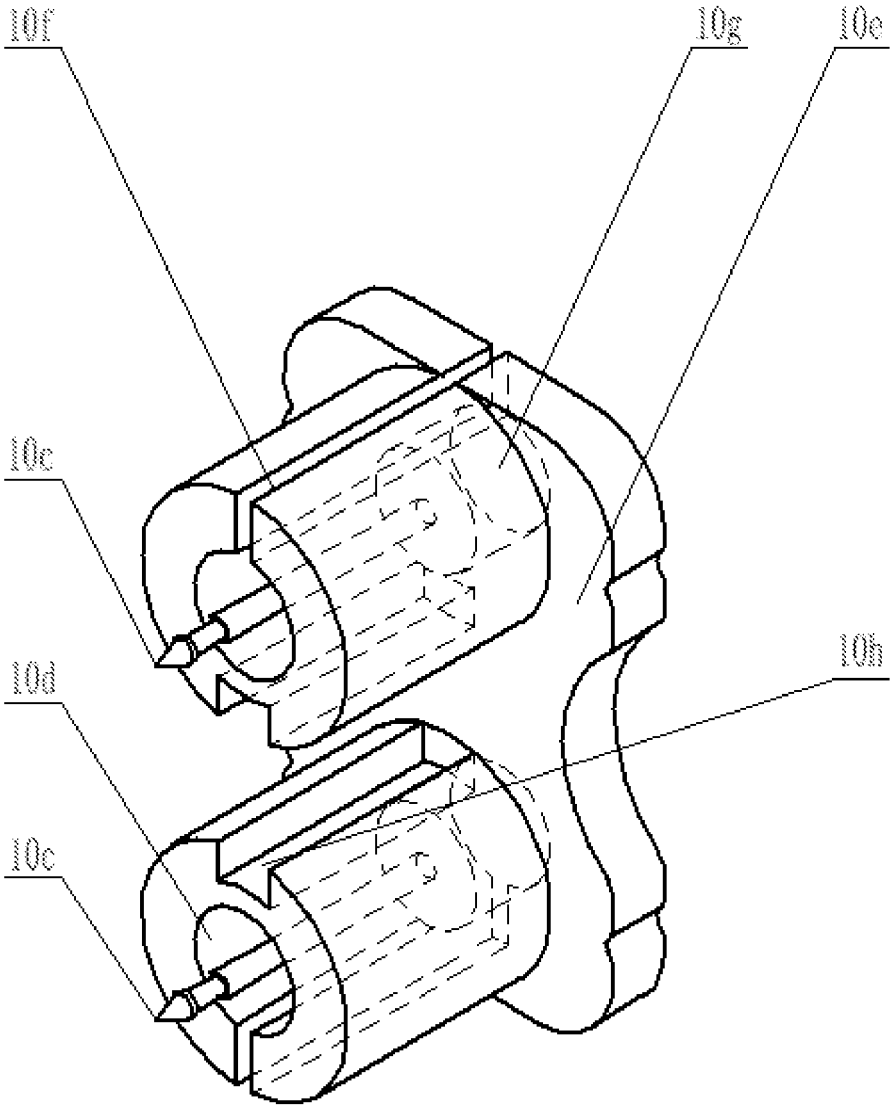
FIG. 19 is a structural diagram of a second type of stud mounting portion of the gun-shaped ear piercer according to the second embodiment of the present application.
Figure 20:
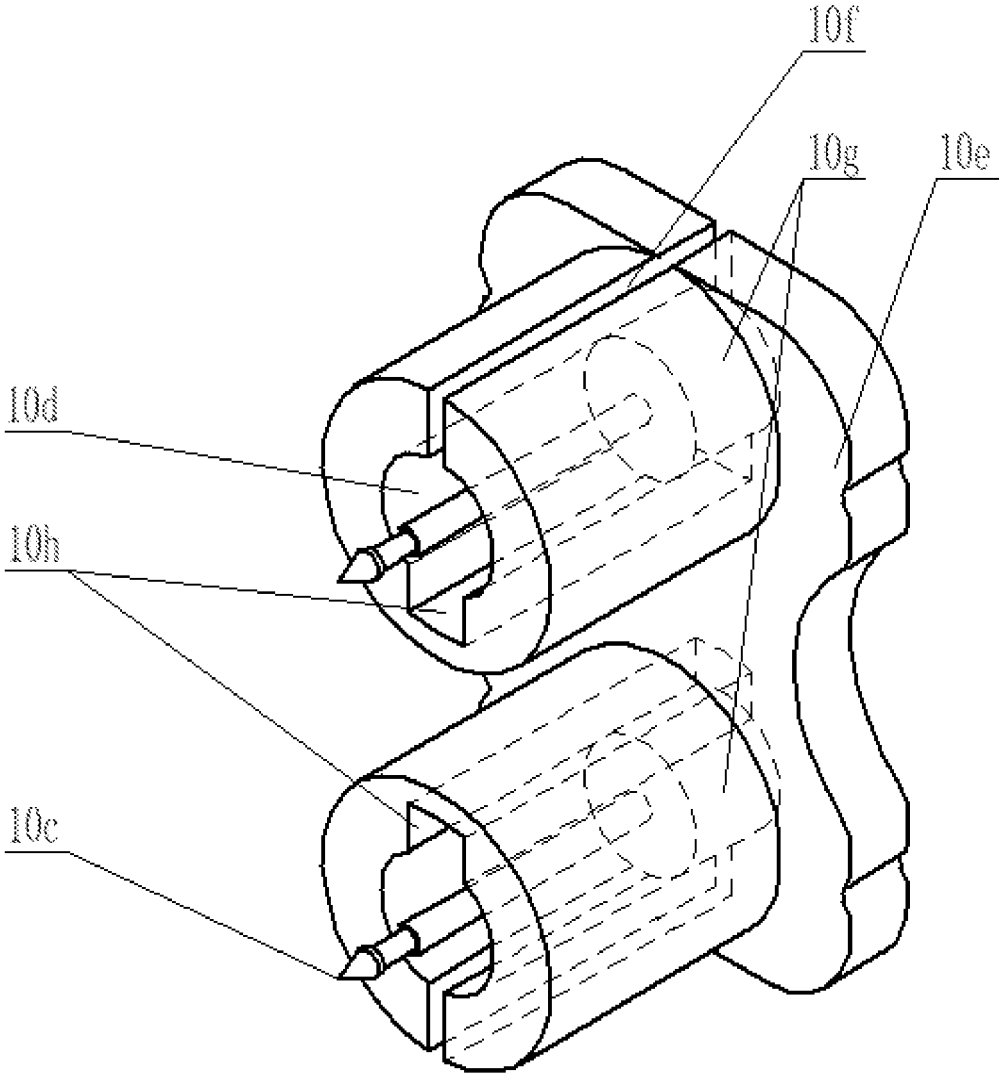
FIG. 20 is a structural diagram of a third type of stud mounting portion of the gun-shaped ear piercer according to the second embodiment of the present application.

As shown in FIGS. 1 to 20, according to an embodiment of the present application, a gun-shaped ear piercer is provided, including a front portion 1 and a rear portion 2, which are sleeved together and can move relatively. A track 7, having a front slot 7*a* for mounting a stud base mounting portion 9 disposed on one end thereof away from the rear portion 2, as well as a fixed portion 11 for mounting a stud mounting portion 10 disposed thereon in a sliding manner, is disposed on the front portion 1. A firing device corresponding to the fixed portion 11 is disposed on the rear portion 2. The front portion 1 includes a grip having an unlocking trigger 6 disposed on a front side thereof, an elastic reset device as well as an aiming stroke restrainer are disposed between the front portion 1 and the rear portion 2, the aiming stroke restrainer is configured to restrain the firing device from moving to an aimed position when firing device is in an aiming stroke, and the unlocking trigger 6 is configured to trigger the firing device to enter an piercing stroke for piercing the earlobe.

The front portion 1 and the rear portion 2 of the gun-shaped ear piercer are reset by the elastic reset device, and the aiming stroke is confined by the aiming stroke restrainer, so that the gun-shaped ear piercer can stably be stopped at the aimed position after entering the aiming stroke to meet the requirement of keeping a first ear piercer that aims at the earlobe still, and the firing device is triggered by the separate unlocking trigger 6 to enter the piercing stroke to make a stud 10*a* pierce through the earlobe. Since the unlocking trigger 6 is located at a front side of the grip of the front portion 1, the unlocking trigger 6 when pulled may be held and triggered by other fingers except the thumb. Slight hand motion may effectively avoid the problem that the first ear piercer deviates from a piercing position in the process of triggering with the thumb, and ensure that two gun-shaped ear piercers operate at the same time to make the piercing position more accurate and hardly deviate from the piercing position, thus improving the convenience and accuracy of ear piercing operations.

The gun-shaped ear piercer according to the present application is of a gun-shaped structure, in which the stud base mounting portion 9 and the stud mounting portion 10 are mounted on a gun barrel of the front portion 1, thus piercing the ears easily. The grip according to the present application is formed on a gun handle, where the grip consists of two portions, namely a grip of the front portion 1 and a grip of the rear portion 2 which are sleeved together to form a complete grip. Since the unlocking trigger 6, with its position similar to that of a trigger of a gun, is disposed on the grip of the front portion 1, the unlocking trigger 6 when pulled may be operated directly by the index finger in the same way as the gun, so that the unlocking trigger may be pulled more smoothly and ergonomically. Moreover, the motion of the index finger is only to pull the trigger slightly, so the motion is relatively slight, which can keep the overall stability and balance of the gun-shaped ear piercer and thus effectively ensure the accuracy and reliability of the ear piercing operation.

The elastic reset device is disposed between the front portion 1 and the rear portion 2 to ensure that the two portions may be kept away from a predetermined position without external force, so that the firing device on the rear portion 2 is kept away from a position where the stud 10*a* is located before the operation of the gun-shaped ear piercer starts, which facilitates operations such as mounting the stud 10*a*, and can reserve the movable space required for a next aiming stroke at the same time.

In the present application, the elastic reset device includes a handle return spring 8 with one end connected to the front portion 1 and the other end connected to the rear portion 2, so that the front portion 1 and the rear portion 2 are connected together to form a complete gun-shaped structure. A spring sleeve, in which the handle return spring 8 is sleeved and fixed, is disposed on the rear portion 2, and a spring link, to which the handle return spring 8 is connected, is disposed on the front portion 1. When the handle spring 8 is in a naturally extended state, the front portion 1 and the rear portion 2 are sleeved together and partially overlap, so that the front portion 1 and the rear portion 2 can be integrated without falling out of a sleeve. The front portion 1 and the rear portion 2 can be directly held to close when needed. After overcoming the elastic action of the handle spring 8, the front portion 1 and the rear portion 2 are closed, with an overlapped portion thereof enlarging and the overall width of a holding portion reducing. In this case, the handle return spring 8 has an elastic force to expand outward, so when the external force disappears, the handle return spring 8 can spring the front portion 1 and the rear portion 2 apart, making the two restore the initial state.

The track 7 is fixedly disposed on the front portion 1. The track 7 may be designed and machined separately from and then fixedly connected to the front portion 1, or may be directly molded on the front portion 1. The front slot 7*a* is disposed at one end of the track 7, and the fixed portion 11 is disposed at the other end. A fixed portion slot 11*a*, on which the stud mounting portion 10 is fixedly disposed, is disposed on the fixed portion 11. The fixed portion 11 is disposed on the track 7 in a sliding manner, so as to adjust its relative position with the front slot 7*a*. Because of the relative movement thereof, the fixed portion 11 and the front slot 7*a* can be configured to respectively mount the stud base mounting portion 9 and the stud mounting portion 10 which are separated. Compared with a cassette design in which the stud base mounting portion 9 and the stud mounting portion 10 are integrated, the separated structure is less costly to design and manufacture, but requires higher machining accuracy to ensure that the stud base mounting portion 9 and the stud mounting portion 10 are in place at the same time. The above mounting structure of the front slot 7*a* and the fixed portion 11 also applies to the cassette in which the stud base mounting portion 9 and the stud mounting portion 10 are integrated.

A spring locking piece 5, which is disposed on a firing path of the firing device for locking the firing device, is disposed in the rear portion 2, and the unlocking trigger 6 is in drive connection with spring locking piece 5 to drive the spring locking piece 5 to unlock the firing device. The unlocking trigger 6 is disposed on the front portion 1, the spring locking piece 5 is disposed on the rear portion 2, the spring locking piece 5 needs to keep the firing device locked all the time before the firing device reaches the aimed position, and the unlocking trigger 6 needs to drive the spring locking piece 5 to unlock the firing device locked by the spring locking piece 5 after the firing device reaches the aimed position to ensure that the firing device can fire the stud 10*a*, so the driving relation between the unlocking trigger 6 and the spring locking piece 5 may be set in such way that the unlocking trigger 6 cannot drive the spring locking piece 5 if the unlocking trigger 6 and the spring locking piece 5 do not reach a driving position before the firing device reaches the aimed position. The driving relation may also be set in such way that a drive structure may be formed between the unlocking trigger 6 and the spring locking piece 5 before the firing device reaches the aimed position, but the unlocking trigger 6 is limited by other structures and thus cannot drive the spring locking piece 5. Only when the firing device reaches the aimed position will the unlocking trigger 6 be released by limiting structures. Only in this case, the unlocking trigger 6 can drive the spring locking piece 5. Such structure can effectively avoid the unlocking trigger 6 from falsely triggering the spring locking piece 5, and improve the operation safety, reliability and accuracy of the gun-shaped ear piercer.

In the present application, the spring locking piece 5 may be rotatably disposed on the rear portion 2, a torsion spring 5*a* for returning the spring locking piece 5 is disposed between the spring locking piece 5 and the rear portion 2, and the spring locking piece 5 includes a locking end 5*c* configured to lock the firing device and a triggering end 5*b* configured to unlock together with the unlocking trigger 6. The spring locking piece 5 is similar to a lever structure, with a center section thereof mounted on the rear portion 2 through the torsion spring 5*a*, and the torque of the torsion spring 5*a* provides a locking force for locking the firing device. One end of the spring locking piece 5 forms a stop end that may be clamped on the firing path of the firing device to lock the firing device, while the other end thereof may form a driving relation with the unlocking trigger 6 after the firing device reaches the aimed position, and the firing device is unlocked under the drive of the unlocking trigger 6.

A hollow tube 2*a* is disposed on the top of the rear portion 2, the firing device includes a firing pin 3 and a firing spring 4, which are mounted in the hollow tube 2*a*, and both ends of the firing spring 4 are elastically propped against the firing pin 3 and the firing spring 4 respectively. A strip-shaped notch 2*b*, below which the spring locking piece 5 is disposed, is disposed below the hollow tube 2*a*, and the locking end 5*c* of the spring locking piece 5 extends into the notch 2*b* to lock the firing device together with the firing pin 3.

A ring groove 3*b* is disposed on the firing pin 3, and the locking end 5*c* of the spring locking piece 5 is snapped into the ring groove 3*b* when the spring locking piece 5 is locked, and is detached from the ring groove 3*b* when the spring locking piece 5 is unlocked. The ring groove 3*b* may also be a recess, provided that the locking end 5*c* of the spring locking piece 5 can be snapped into the recess to stop the firing pin 3.

The firing pin 3 includes a major-diameter section disposed at a front end thereof, as well as a minor-diameter section disposed at a rear end thereof and coming out from the hollow tube 2*a*, the ring groove 3*b* is disposed at the major-diameter section, one end of the firing spring 4 is propped against one end of the major-diameter section connected to the minor-diameter section, while the other end thereof is propped against an end wall of the hollow tube 2*a*. The firing pin 3 is of a structure in which the major-diameter section and the minor-diameter section are fitted to each other, which may form a stop step by different diameters of the major-diameter section and the minor-diameter section, so that one end of the firing spring 4 may be stopped on the stop step while the other end thereof may be stopped on the end wall of the hollow tube 2*a*. A hole, through which the minor-diameter section partially comes out of the hollow tube 2*a*, is formed on the end wall of the hollow tube 2*a*, so that the firing pin 3 may be operated easily by the minor-diameter section. After firing, the firing pin 3 can be returned to its original position by operating the minor-diameter section, and the spring locking piece 5 can be snapped into the ring groove 3*b* of the firing pin 3 again, thus locking the firing pin 3 for the next piercing operation.

A tail hook 3*a* suitable for holding is disposed on a tail of the firing pin 3 coming out of the hollow tube 2*a*. In practice, an eye splice may also be mounted on the tail hook 3*a*, so that the tail hook 3*a* can be pulled back more easily. When the tail hook 3*a* is pulled back and the firing pin 3 moves back to press the firing spring 4 to a certain position, the spring locking piece 5 is snapped into the ring groove 3*b* on the firing pin 3 to tighten the firing spring 4, so that the firing pin 3 is in a state to be fired. When the firing pin 3 moves back to be fired, the stud mounting portion 10 is inserted into the fixed portion slot 11*a* of the fixed portion 11, and the firing pin 3 is just aimed at the stud 10*a* in an elastic track 10*d*.

A mounting groove, having the unlocking trigger 6 disposed therein, is disposed on a front side of the grip of the front portion 1, a first end of the unlocking trigger 6 is hinged to the front portion 1 and connected to the front portion 1 through a torsion spring 6*a*, while a second end thereof is blocked on an inner wall of the front portion 1. A trigger boss 6*c* is disposed on the top of the unlocking trigger 6, and a side catch 6*b* is disposed on at least one side of the unlocking trigger 6; and a straight slot 2*h* is disposed on a lower side of the rear portion 2, the trigger boss 6*c* is at least partially disposed in the straight slot 2*h*, and the side catch 6*b* is blocked outside the straight slot 2*h*. The mounting groove is located at the front side of the grip, and its position is similar to that of a trigger of a pistol, allowing a more pistol-like structure and easier manual operations. The first end of the unlocking trigger 6 is hinged to the front portion 1, while the second end thereof is in a cantilever position and pressed against the inner wall of the front portion 1 under the elastic action of the torsion spring 6*a*. Therefore, before being operated by hand, the unlocking trigger 6 will not trigger the spring locking piece 5 under the elastic action of the torsion spring 6*a* to release the spring locking piece 5. The first end of the unlocking trigger 6 is hinged, and is provided with an arc-shaped structure at an end, which can provide a larger space for the unlocking trigger 6 to rotate without interference with the front portion 1, and thus more effectively ensure that the unlocking trigger 6 has enough release ability and larger moving range to release the spring locking piece 5 effectively.

In this embodiment, a hook is disposed at an end of the second end of the unlocking trigger 6, and an overhead hook is further disposed at a position where a wall of the mounting groove of the front portion 1 is fitted to the second end of the unlocking trigger 6. The hook of the unlocking trigger 6 is hooked to the overhead hook under the action of the torsion spring 6*a*, thus effectively preventing the second end of the unlocking trigger 6 from falling out of the mounting groove, and improving the stability and reliability of the mounting structure of the unlocking trigger 6 in the front portion 1.

Optionally, the side catch 6*b* is disposed on the side of the trigger boss 6*c*. The side catch 6*b* are disposed on both sides of the trigger boss 6*c* respectively, which can ensure that the wall of the straight slot 2*h* uniformly blocks the trigger boss 6*c*. The trigger boss 6*c* is provided to ensure that the unlocking trigger 6 only partially enters the straight slot 2*h*, and a raised structure of the trigger boss 6*c* forms a driving relation with the spring locking piece 5 more easily, so as to trigger and release the spring locking piece 5.

A blocking piece 2*f* protruding towards the unlocking trigger 6 is further disposed on the lower side of the rear portion 2, the spring locking piece 5 is disposed at a rear side of the blocking piece 2*f*. Before the front portion 1 and the rear portion 2 are completely closed, the trigger boss 6*c* of the unlocking trigger 6 is located at the blocking piece 2*f*, and the unlocking trigger 6 is pressed against the inner wall of the front portion 1 by the blocking piece 2*f*. After the front portion 1 and the rear portion 2 are completely closed, the trigger boss 6*c* of the unlocking trigger 6 is staggered from the blocking piece 2*f*, the side catch 6*b* passes over the protruded blocking piece 2*f* and is fitted to the triggering end 5*b* of the spring locking piece 5. In this case, the unlocking trigger 6 can fully rotate to a proper position, and the trigger boss 6*c* of the unlocking trigger 6 can drive the triggering end 5*b* of the spring locking piece 5 to move and in turn drive the spring locking piece 5 to rotate, so that the locking end 5*c* of the spring locking piece 5 is dislocated from a locked position to unlock the firing device and release the firing spring 4, so as to complete the firing process.

The blocking piece 2*f* is shorter than the aiming stroke in length, so that the trigger boss 6*c* of the unlocking trigger 6 can completely stagger from the blocking piece 2*f* and reaches a position where the spring locking piece 5 is located after the aiming stroke is finished, so as to unlock the spring locking piece 5 in time and effectively.

The rear portion 2 is sleeved in the front portion 1, and the aiming stroke restrainer includes stop pins disposed on the front portion 1, and stop grooves disposed on the rear portion 2. The stop pins are disposed on an upper portion and a lower portion of a fitting portion of the front portion 1 and the rear portion 2 respectively, and the stop grooves are disposed at corresponding positions of the rear portion 2, and the stroke of the stop pin in the stop groove is the aiming stroke.

Specifically, the front portion 1 includes a front piece 1*a* and a rear piece 1*b*, which are spliced to form the front portion 1. The stop pins 1*d* and 1*e* are disposed on the front portion 1, and the stop grooves 2*d* and 2*e* are disposed on the rear portion 2, where the stop pin 1*d* can slide in the stop groove 2*d*, the stop pin 1*e* can slide in the stop groove 2*e*, and the stop groove 2*d* is parallel to the stop groove 2*e*. The structure in which the two sets of stop pins and stop grooves are fitted to each other can effectively guide the movement of the rear portion 2 relative to the front portion 1, thus ensuring the accuracy of the movement direction of the rear portion 2 and the accuracy of the ear piercing operation. The stroke of the stop pin in the stop groove is the aiming stroke, which can effectively confine the length and end point of the aiming stroke, and ensure the accuracy of the aimed position, ensure that the firing device stops in time after reaching the aimed position, to meet the requirement of keeping a first ear piercer that aims at the earlobe still.

As shown in FIGS. 1 to 10, according to the first embodiment of the present application, the fixed portion 11 and the rear portion 2 are disposed separately, the stop pin 1*c* is disposed on the front portion 1, the stop groove 2*c* in which the stop pin 1*c* can slide is disposed on the rear portion 2, and a fixed portion return spring 11*b*, with one end hooked to the stop pin 1*c* and the other end connected to the fixed portion 11, is connected between the fixed portion 11 and the front portion 1.

In this embodiment, after the firing device completes the firing operation and returns back, the fixed portion return spring 11*b* can pull the fixed portion 11 back, allowing the fixed portion 11 to return to its original position.

The front portion 1 is further provided with a stopper 1*f* which is stopped between the fixed portion 11 and an end of the hollow tube 2*a*, so that a clearance 12 is formed between the fixed portion 11 and an end face 2*g* of the hollow tube while the fixed portion return spring 11*b* generates a pre-tensioning force before the front portion 1 and the rear portion 2 are closed.

The clearance 12 between the fixed portion 11 and the end face 2*g* of the hollow tube makes a blister box 13, which serves as a material for packaging the stud base mounting portion 9 and the stud mounting portion 10, go down into place, so that the stud base mounting portion 9 and the stud mounting portion 10 can be snapped into the front slot 7*a* and the fixed portion slot 11*a* simultaneously.

The gun-shaped ear piercer further includes the stud mounting portion 10 having a elastic track 10*d*, a stud holder 10*b* and a stud 10*a*, the tubular elastic track 10*d* is tubular and includes a radial slit 10*f* extending in the movement direction of the stud 10*a*. The slit 10*f* allows the elastic track 10*d* to have a certain elastic force to properly clamp the stud holder 10*b* mounted in the elastic track 10*d*, so that the stud holder may be stably fixed without moving back and forth, and may also move under the action of the firing pin 3 with little friction. The stud holder 10*b* includes two clamping pieces 10*b*1 and 10*b*2, which, when closed, can clamp a stud head 10*g* in the middle to only expose a stud tip 10*c*.

In this embodiment, the whole piercing process of the gun-shaped ear piercer includes three strokes, namely a first stroke (idle stroke) where the front portion 1 and the rear portion 2 of the gun-shaped ear piercer are closed to eliminate the clearance 12, a second stroke (aiming stroke) where the stud mounting portion 10 and the stud base mounting portion 9 are closed to each other, and a third stroke (piercing stroke) where the spring and the firing pin 3 drive the stud 10*a* to move forward.

When there is a need of ear piercing, a lower portion of the gun-shaped structure is held by hand, and the handle return spring 8 is pressed by closing the hand, so that the rear portion 2 moves toward the front portion 1 to finish the first stroke (idle stroke) equivalent to the width of the clearance 12, making the end face 2*g* of the hollow tube propped against the fixed portion 11. When the rear portion 2 continues to move forward, the end face 2*g* of the hollow tube drives the fixed portion 11 to finish the second stroke (aiming stroke) to the end, so that the stud tip 10*c* of the stud 10*a* on the stud mounting portion 10 is close to the earlobe and kept still. This is the process of aiming, positioning and keeping still before ear piercing.

When pulled by the index finger, the unlocking trigger 6 rotates to trigger the spring locking piece 5 to move down to release the firing spring 4, so that the firing pin 3 drive the stud holder 10*b* in the elastic track 10*d* and the stud 10*a* wrapped therein to move in the elastic track 10*d*, and the stud 10*a* is inserted into a stud base 9*a* after piercing through the earlobe. This stroke is the third stroke (piercing stroke) driven by the spring and the firing pin 3. Thus it can be seen that the stud 10*a* takes three strokes from approaching to piercing the earlobe.

When the above operations are completed, the stud base mounting portion 9 is designed as a mechanism in which the stud base 9*a* will be detached from the stud base mounting portion 9 when the stud 10*a* is inserted into the stud base 9*a*, the stud base 10 is also designed as a mechanism in which the stud 10*a* will be detached from the stud holder 10*b* once the stud holder 10*b* is detached from the elastic track 10*d* (the stud holder 10*b* is formed by closing the two clamping pieces 10*b*1 and 10*b*2 together, and will be automatically separated once detached from the elastic track 10*d*), so when the stud 10*a* is inserted into the stud base 9*a* after piercing through the earlobe, the stud base 9*a* and the stud 10*a* will be detached from the stud base mounting portion 9 and the elastic track 10*d* at the same time and both left on the earlobe. In this way, the entire ear piercing process is completed.

As shown in FIGS. 11 to 20, according to a second embodiment of the present application, a fixed portion 11 is disposed at an end of a hollow tube 2*a* and forms an integrated structure with the hollow tube 2*a*.

In this embodiment, a stud base mounting portion 9 and a stud mounting portion 10 are taken out of a blister box 13 and put into the gun-shaped ear piercer respectively, so there is no clearance 12 between the fixed portion 11 and a firing pin 3, and the fixed portion 11 is connected to an end face 2*g* of the hollow tube. Thus, one stroke is omitted, and the gun becomes a two-stroke gun-shaped ear piercer. At the same time, since the fixed portion 11 is fixed on the rear portion 2, a fixed portion return spring 11*b* is also omitted, which simplifies the structure of the gun-shaped ear piercer, and reduces the structural complexity and the machining cost.

The gun-shaped ear piercer further includes a stud mounting portion 10 having two elastic tracks 10*d*, a stud 10*a* which can slide in the elastic track 10*d* is disposed in each track, and the stud mounting portion 10 is of a centrosymmetric structure.

In this embodiment, the fixed portion 11 is provided at a front end of the hollow tube 2*a* of the rear portion 2. A fixed portion slot 11*a*, to which the stud mounting portion 10 is fixed, is disposed on the fixed portion 11. There are two elastic tracks 10*d* and inserts 10*e* on the stud mounting portion 10. Each elastic track 10*d* is of a tubular structure having at least one slit 10*f* running through, and the stud 10*a* is directly mounted in the elastic track 10*d*.

Two stud bases 9*a* are mounted on the stud base mounting portion 9, and two elastic tracks 10*d* each having a stud 10*a* mounted respectively therein are mounted on the stud mounting portion 10. When the gun-shaped ear piercer completes a first ear piercing operation, after rotating 180 degrees, the stud base mounting portion 9 and the stud base mounting portion 10 may be mounted on the gun-shaped ear piercer to complete a second ear piercing operation. In this way, the cost is further reduced.

Each elastic track 10*d* is of a tubular structure having a cylindrical inner cavity as well as at least two straight slots axially extending, and at least one straight slot runs through a tube wall of the tubular structure.

Since an inner cavity of the tubular structure is cylindrical, the stud head 10*g* of the stud 10*a* is cylindrical. With the cylindrical stud head 10*g*, the stud 10*a* can be directly mounted in the elastic track 10*d* without the stud holder 10*b*, and the stud tip 10*c* keeps moving forward stably when the stud 10*a* moves in the elastic track 10*d*, thus reducing the cost of the stud 10*a*.

In one of the embodiments of the stud mounting portion 10, the two straight slots of the tubular structure are located at both ends of the same diameter of the tubular structure respectively, and run through tube wall of the tubular structure.

In another embodiment of the stud mounting portion 10, the two straight slots of the tubular structure are located at both ends of the same diameter of the tubular structure respectively, where one straight slot runs through the tube wall of the tubular structure, and the other straight slot, having a slot depth less than a wall thickness of the tubular structure, is located on an outer wall or an inner wall of the tubular structure, thus forming a flute 10*h* at a position which is a hinge point of elastic deformation of an elastic tube.

With any of the above three structures of the elastic track 10*d*, the stud head 10*g* varying in diameter in a certain range can be stably mounted in the elastic track 10*d*, and can move back and forth while keeping the stud tip 10*c* of the stud 10*a* from swinging, thereby reducing the machining accuracy of the stud 10*a* and the production cost and improving the yield.

When there is a need of ear piercing, the lower portion of the gun-shaped structure is held by hand, and the handle return spring 8 is pressed by closing the hand, so that the rear portion 2 moves toward the front portion 1, and the fixed portion 11 and the firing pin 3 move forward for an aiming stroke accordingly, so that the stud tip 10*c* of the stud 10*a* on the stud mounting portion 10 is close to the earlobe and keeps still. This is the process of aiming, positioning and keeping still before ear piercing.

When the index finger pulls the unlocking trigger 6, the unlocking trigger 6 rotates to trigger the spring locking piece 5 to move downward to release the firing spring 4, so that the firing pin 3 drives the stud 10*a* in the elastic track 10*d* to move forward to insert into the stud base 9*a* after piercing through the earlobe.

The side catches 6*b* preventing false triggering are disposed on side faces of the unlocking trigger 6, and the protruded blocking pieces 2*f* are disposed on the rear portion 2. Before the front portion 1 and the rear portion 2 are completely closed, if the unlocking trigger 6 is accidentally pulled, the side catch 6*b* will be blocked by the protruded blocking piece 2*f* on the rear portion 2 to limit the rotation of the unlocking trigger 6, thereby avoiding false triggering of the spring locking piece 5. Only when the front portion 1 and the rear portion 2 are completely closed will the side catch 6*b* pass over the protruded blocking piece 2*f*. In this case, the unlocking trigger 6 can fully rotate to a proper position to drive the spring locking piece 5 to rotate and release the firing spring 4, so as to complete the firing process.

After that, the hand is unlocked, and the rear portion 2 moves back under the action of the handle return spring 8, and the stud 10*a* is detached from the elastic track 10*d*. The stud base mounting portion 9 is designed as a mechanism in which the stud base 9*a* will be detached from the stud base mounting portion 9 when the stud 10*a* is pierced into the stud 9*a*, so when the stud 10*a* is pierced into the stud base 9*a* after piercing through the earlobe, the stud base 9*a* and the stud 10*a* will be detached from the stud base mounting portion 9 and the stud mounting portion 10 at the same time and both left on earlobe. In this way, the entire ear piercing process is completed.

It is readily understood by those of skill in the art that the above advantageous embodiments may be freely combined and superimposed without conflict.

Those described above are merely preferred embodiments of the present application, and are not intended to limit the present application. Any modifications, equivalent substitutions and improvements made without departing from the spirit and principle of the present application shall fall into the protection scope of the present application. Those described above are merely preferred embodiments of the present application. It should be noted that a number of improvements and variations may be made by those of ordinary skill in the art without departing from the technical principles of the present application, and such improvements and variations shall also fall into the protection scope of the present application.

The invention claimed is:

1. A gun-shaped ear piercer, comprising a front portion and a rear portion, which are sleeved together and can move relatively, wherein a track, having a front slot for mounting a stud base mounting portion disposed on one end thereof away from the rear portion, as well as a fixed portion for mounting a stud mounting portion disposed thereon in a sliding manner, is disposed on the front portion; a firing device corresponding to the fixed portion is disposed on the rear portion; and the front portion comprises a grip having an unlocking trigger disposed on a front side thereof, an elastic reset device as well as an aiming stroke restrainer are disposed between the front portion and the rear portion, the aiming stroke restrainer is configured to restrain the firing device from moving to an aimed position when the firing device is in an aiming stroke, and the unlocking trigger is configured to trigger the firing device to enter a piercing stroke for piercing the earlobe; the rear portion is sleeved in the front portion, and the aiming stroke restrainer comprises stop pins disposed on the front portion and stop grooves disposed on the rear portion; the stop pins are disposed on an upper portion and a lower portion of a fitting portion of the front portion and the rear portion respectively, and the stop grooves are disposed at corresponding positions of the rear portion;

wherein a spring locking piece, which is disposed on a firing path of the firing device for locking the firing device, is disposed in the rear portion, and the unlocking trigger is in drive connection with the spring locking piece to drive the spring locking piece to unlock the firing device; and a mounting groove, having the unlocking trigger disposed therein, is disposed on a front side of the grip of the front portion, a first end of the unlocking trigger is hinged to the front portion and connected to the front portion through a torsion spring, while a second end thereof is blocked on an inner wall of the front portion; a trigger boss is disposed on the top of the unlocking trigger, and a side catch is disposed on at least one side of the unlocking trigger; and a straight slot is disposed on a lower side of the rear portion, the trigger boss is at least partially disposed in the straight slot, and the side catch is blocked outside the straight slot.

2. The gun-shaped ear piercer according to claim 1, wherein the spring locking piece is disposed on the rear portion, a torsion spring for returning the spring locking piece is disposed between the spring locking piece and the rear portion, and the spring locking piece comprises a locking end configured to lock the firing device and a triggering end configured to unlock together with the unlocking trigger.

3. The gun-shaped ear piercer according to claim 2, wherein a hollow tube is disposed on the top of the rear portion, the firing device comprises a firing pin and a firing spring, which are mounted in the hollow tube, and both ends of the firing spring are elastically propped against the firing pin and an end wall of the hollow tube respectively; and a strip-shaped notch is disposed below the hollow tube, and the locking end of the spring locking piece extends into the notch to lock the firing device together with the firing pin.

4. The gun-shaped ear piercer according to claim 3, wherein a ring groove is disposed on the firing pin, and the locking end of the spring locking piece is snapped into the ring groove when the spring locking piece is locked, and is detached from the ring groove when the spring locking piece is unlocked.

5. The gun-shaped ear piercer according to claim 4, wherein the firing pin comprises a major-diameter section disposed at a front end thereof, as well as a minor-diameter section disposed at a rear end thereof and coming out from the hollow tube, the ring groove is disposed at the major-diameter section, one end of the firing spring is propped against one end of the major-diameter section connected to the minor-diameter section, while the other end thereof is propped against the end wall of the hollow tube.

6. The gun-shaped ear piercer according to claim 2, wherein a blocking piece protruding towards the unlocking trigger is further disposed on the lower side of the rear portion, the spring locking piece is disposed at a rear side of the blocking piece; before the front portion and the rear portion are completely closed, the trigger boss of the unlocking trigger is located at the blocking piece, and the unlocking trigger is pressed against the inner wall of the front portion by the blocking piece; after the front portion and the rear portion are completely closed, the trigger boss of the unlocking trigger is staggered from the blocking piece and is fitted to the triggering end of the spring locking piece; the unlocking trigger can be pulled, and the trigger boss of the unlocking trigger can drive the triggering end of the spring locking piece to move, so that the locking end of the spring locking piece is dislocated from a locked position to unlock the firing device.

7. The gun-shaped ear piercer according to claim 3, wherein the fixed portion and the rear portion are disposed separately, each stop pin is disposed on the front portion, each stop groove in which each stop pin can slide is disposed on the rear portion, and a fixed portion return spring, with one end hooked to a stop pin of the stop pins and the other end connected to the fixed portion, is connected between the fixed portion and the front portion.

8. The gun-shaped ear piercer according to claim 7, wherein the front portion is further provided with a stopper which is stopped between the fixed portion and an end of the hollow tube, so that a clearance is formed between the fixed portion and the hollow tube while the fixed portion return spring generates a pretensioning force before the front portion and the rear portion are closed.

9. The gun-shaped ear piercer according to claim 7, wherein the gun-shaped ear piercer further comprises the stud mounting portion having an elastic track, a stud holder and a stud, and the elastic track is tubular and comprises a radial slit extending in a movement direction of the stud.

10. The gun-shaped ear piercer according to claim 3, wherein the fixed portion is disposed at an end of the hollow tube and forms an integrated structure with the hollow tube.

11. The gun-shaped ear piercer according to claim 10, wherein the gun-shaped ear piercer further comprises the stud mounting portion having two elastic tracks, two studs which can slide in each elastic track are disposed in each elastic track, and the stud mounting portion is of a centrosymmetric structure.

12. The gun-shaped ear piercer according to claim 11, wherein each elastic track is of a tubular structure having a cylindrical inner cavity as well as at least two straight slots axially extending, and at least one straight slot runs through a tube wall of the tubular structure.

13. The gun-shaped ear piercer according to claim 12, wherein the two straight slots of the tubular structure are located at both ends of the same diameter of the tubular structure respectively, and run through the tube wall of the tubular structure.

14. The gun-shaped ear piercer according to claim 13, wherein the two straight slots of the tubular structure are located at both ends of the same diameter of the tubular structure respectively, where one straight slot runs through the tube wall of the tubular structure, and the other straight slot, having a slot depth less than a wall thickness of the tubular structure, is located on an outer wall or an inner wall of the tubular structure.

* * * * *